US006070977A

United States Patent [19]

Nuita et al.

[11] Patent Number: 6,070,977

[45] Date of Patent: Jun. 6, 2000

[54] INK-JET PRINTER CONTROLLING APPLICATION OF PRINTING MEDIUM TO A ROTARY DRUM

[75] Inventors: Akira Nuita; Tadao Kamano, both of Shizuoka-ken; Takashi Kashiwagi; Shinichiro Fujii, both of Mishima; Masaaki Oyaide, Shizuoka-ken; Izumi Araki, Mishima; Juntaro Oku, Numazu, all of Japan

[73] Assignee: Toshiba TEC Kabushiki Kaisha, Shizuoka, Japan

[21] Appl. No.: 08/967,182

[22] Filed: Nov. 10, 1997

[30] Foreign Application Priority Data

| | | | |
|---|---|---|---|
| Nov. 11, 1996 | [JP] | Japan | 8-298349 |
| Nov. 28, 1996 | [JP] | Japan | 8-317332 |
| Nov. 28, 1996 | [JP] | Japan | 8-317333 |

[51] Int. Cl.[7] ..... B41J 2/01

[52] U.S. Cl. ..... 347/104; 271/275

[58] Field of Search ..... 347/104, 105, 347/101; 399/361, 367, 371, 381, 388, 392, 394; 346/134, 138; 271/264, 275, 277, 9.09, 8.1, 153; 400/611, 624, 629

[56] References Cited

U.S. PATENT DOCUMENTS

| | | | |
|---|---|---|---|
| 4,268,841 | 5/1981 | Fujii et al. | 347/104 X |
| 4,436,406 | 3/1984 | Murasaki et al. | 399/392 |
| 4,786,920 | 11/1988 | Igarashi | 347/139 X |
| 5,249,024 | 9/1993 | Menjo | 347/102 X |
| 5,455,604 | 10/1995 | Adams et al. | 347/104 |
| 5,517,222 | 5/1996 | Sugiyama et al. | 347/104 X |

FOREIGN PATENT DOCUMENTS 2514524 8/1996 Japan .

*Primary Examiner*—William Royer
*Assistant Examiner*—Hoan Tran
*Attorney, Agent, or Firm*—Frishauf, Holtz, Goodman, Langer & Chick, P.C.

[57] ABSTRACT

An ink-jet printer includes a rotary drum for rotating at a constant speed and holding a paper sheet on its peripheral surface, a print head having ink-jet nozzles aligned in the axial direction of the rotary drum to perform printing by spitting ink from these ink-jet nozzles on the paper sheet rotating together with the rotary drum, and a sheet feed-in mechanism for feeding a paper sheet from a cassette and a manual feed tray to the rotary drum. Particularly, the sheet feed-in mechanism has a loading roller unit for loading the paper sheet to the rotary drum, a pickup section for picking up a paper sheet from one of the cassette and the manual feed tray to strike the leading end of the paper sheet against the loading roller unit, and a control section for controlling the loading roller unit to feed, to the rotary drum, the paper sheet whose posture has been corrected upon strike by the pickup section. The pickup section has a paper feed path which guides the paper sheet picked up from one of the cassette and the manual feed tray to the loading roller unit via a merging point, and has a bend accepting space located at the merging point for accepting a bend of the paper sheet.

9 Claims, 14 Drawing Sheets

INK-JET PRINTER CONTROLLING APPLICATION OF PRINTING MEDIUM TO A ROTARY DRUM

BACKGROUND OF THE INVENTION

The present invention relates to an ink-jet printer for performing printing by spitting ink on a paper sheet held by a rotary drum.

In recent years, high-performance, low-cost personal computers are easily accessible, and are spreading rapidly. With this rapid spread, demands for color printers also increasing. At present, a serial ink-jet printer is known as a color printer suitable for personal use.

A general serial ink-jet printer 500 will now be described with reference to FIGS. 1 and 2. The ink-jet printer 500 is constituted to, while moving a print head 501 across a paper sheet M in a main scanning direction X, spit ink on the paper sheet M to perform printing of one line, and supply the paper sheet M at a predetermined pitch along a paper feed path set in a sub-scanning direction Y perpendicular to the main scanning direction X every printing of one line. The print head 501 has first to fourth nozzle units 502 for printing an image in yellow, magenta, cyan, and black. Each nozzle unit 502 has a plurality of ink-jet nozzles aligned in the sub-scanning direction Y at a pitch P required to obtain a predetermined resolution. For example, for a resolution of 300 dots/inch, the nozzle pitch P is set at 1/300 inch. These ink-jet nozzles are oriented to the paper sheet M fed in the sub-scanning direction Y beneath the nozzles, and used to eject ink having a corresponding color which is supplied from first and second detachable ink cassettes 504, and used to put the ink on the paper sheet M. In general, yellow, magenta, and cyan inks are stored in the first ink cassette 504, and a black ink is stored in the second ink cassette 504. The print head 501 is mounted on a carrier 505 driven by a moving mechanism 510. The moving mechanism 510 includes a guide rod 511 extending in the main scanning direction X, a pair of sprockets 512 arranged near the two ends of the guide rod 511, a timing belt 513 disposed between the sprockets 512, and a stepping motor for rotating the timing belt 513 via the sprockets 512 at a predetermined speed. The carrier 505 is fixed to part of the timing belt 513, and set to be reciprocative along the guide rod 511 according to the rotational direction of the timing belt 513.

In the ink-jet printer 500, the paper sheet M is fed in the sub-scanning direction Y along the paper feed path until it opposes the print head 501, and the carrier 505 moves forward along the guide rod 511 in the main scanning direction X. Meanwhile, the ink-jet nozzles of the first to fourth nozzle units 502 spit yellow, magenta, cyan, and black inks on the paper sheet M to perform color printing of one line. After the printing, the carrier 505 moves backward, and the paper sheet M is fed by a distance corresponding to the height of one line. By repeatedly performing this printing operation, an image of characters, symbols, or graphics is color-printed on the entire paper sheet M. Upon completion of the printing, the paper sheet M is further fed in the sub-scanning direction Y and discharged to a discharge space S.

As another color printer, for example, a laser printer 600 shown in FIG. 3 has conventionally been known. The laser printer 600 has processing portions 610Y, 610M, 610C, and 610B aligned along a paper feed path within a main body case 601 in order to perform printing in yellow, magenta, cyan, and black. The paper sheet M is fed by a feed mechanism 620 so as to sequentially pass through the processing portions 610Y, 610M, 610C, and 610B. Each of the processing portions 610Y, 610M, 610C, and 610B includes a photosensitive drum 611 which is set perpendicular to the paper feed path and rotates in one direction, and a laser-beam emitter, a charger, a developing unit, a transfer unit, a waste toner collecting unit, and a discharger which are arranged around the photosensitive drum 611. Each of the processing portions 610Y, 610M, 610C, and 610B forms an electrostatic latent image on the photosensitive drum 611 by a laser beam, supplies a corresponding color toner to be adhered to the latent image as a toner image, transfers this toner image to the paper sheet M fed along the paper feed path, and fixes the toner image using a thermal fixing unit arranged on the paper feed path.

The color printing speed of the ink-jet printer 500 is very low. The printer 500 is constituted to perform printing on the entire paper sheet M fed in the sub-scanning direction Y by the print head 501 which reciprocates in the main scanning direction X. For this reason, a printing time of about 5 to 10 minutes is required for printing of an A4-size paper sheet. When high-resolution color printing is performed for, e.g., an A4-size paper sheet, a printing time of about 5 to 10 minutes is necessary for one paper sheet. If, e.g., the ink cassette 504 is downsized to reduce the load weight of the carrier 505, the printing speed can be increased. However, this results in a decrease in ink exchange interval. Since the ink cassette 504 must have a capacity that covers printing of at least 200 paper sheets by one ink exchange, it is difficult to remarkably improve the printing speed by downsizing the ink cassette 504. Even if the ink cassette 504 is suppressed to the minimum capacity, large noise is generated every time the carrier 505 reciprocates.

On the other hand, since the laser printer 600 is constituted to transfer a toner image adhered to each photosensitive drum 611 to the paper sheet M, no large noise is generated unlike the ink-jet printer 500 in which an ink is spitted on the paper sheet M while reciprocating the carrier. When high-resolution color printing is performed for an A4-size paper sheet, a printing time of about 15 to 20 seconds is required for one paper sheet. That is, printing of four paper sheets can be performed within 1 minute. This color printing speed is much higher than that of the ink-jet printer 500 though the color printing speed is limited by the drum rotation speed set to repeatedly use the photosensitive drum by performing residual toner cleaning, discharging, recharging, and the like for the photosensitive peripheral surface of the drum. This color printing speed does not pose any problem in personal use such as printing of some paper sheets in a postcard size. However, this color printing speed is not satisfactory in office use requiring printing of many paper sheets in larger sizes. Since the high-cost processing portions 610Y, 610M, 610C, and 610B are aligned along the paper feed path, the size and cost of the laser printer 600 inevitably increase. Therefore, the laser printer 600 is not spread as a color printer for personal use.

BRIEF SUMMARY OF THE INVENTION

It is an object of the present invention to provide an ink-jet printer which can improve the efficiency in feeding a printing medium.

According to the present invention, there is provided an ink-jet printer which comprises a rotary drum for rotating at a constant speed and holding a printing medium on a peripheral surface thereof; a print head having ink-jet nozzles aligned in an axial direction of the rotary drum, for performing printing by spitting ink from the ink-jet nozzles on the printing medium rotating together with the rotary drum; and a medium feeding mechanism for feeding the printing medium from a cassette and a manual feed tray to the rotary drum; wherein the medium feeding mechanism includes a loading roller unit for loading the printing medium to the rotary drum, a pickup section for picking up a printing medium from one of the cassette and the manual feed tray to strike a leading end of the printing medium against the loading roller unit, and a control section for controlling the loading roller unit to load, to the rotary drum, the printing medium whose posture is corrected upon strike by the pickup section, and the pickup section includes a medium feed path which guides the printing medium picked up from one of the cassette and the manual feed tray to the loading roller unit via a merging point and has a bend accepting space located at the merging point for accepting a bend of the printing medium.

In this ink-jet printer, the posture of the printing medium can be corrected by striking the printing medium against the loading roller unit. Since the bend accepting space is located at the merging point of the medium feed path, the internal space of the ink-jet printer can be efficiently used.

DETAILED DESCRIPTION OF THE INVENTION

An ink-jet printer according to an embodiment of the present invention will be described below with reference to the accompanying drawings. This ink-jet printer is used to perform multi-color printing for paper M cut into a sheet as a printing medium. The paper sheet M is, e.g., a plain paper sheet or an OHP sheet.

Figure 4:
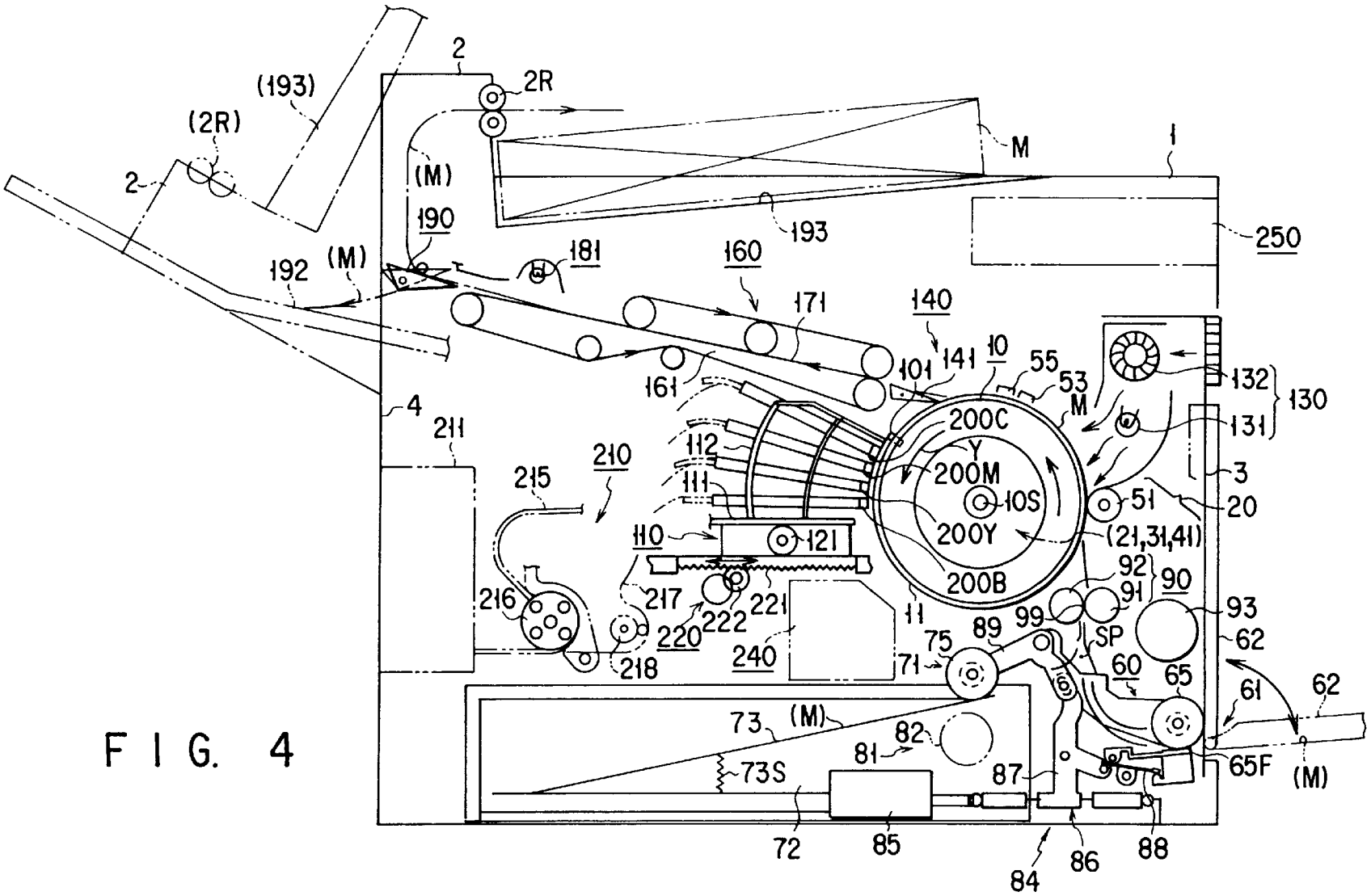
FIG. 4 is a sectional view showing the internal structure of an ink-jet printer according to an embodiment of the present invention.

FIG. 4 shows the internal structure of the ink-jet printer. The ink-jet printer comprises a rotary drum 10 which holds the paper sheet M and rotates at a constant peripheral speed, a color print head 200 for performing printing for the paper sheet M rotating together with the rotary drum 10, a manual feed tray 62 for supporting each paper sheet M inserted one by one, a paper cassette 72 for storing a stack of paper sheets M inserted, a sheet feed-in mechanism 60 for feeding each paper sheet M from the paper cassette 72 and the manual feed tray 62 to the rotary drum 10, a sheet feed-out mechanism 160 for feeding out the paper sheet M printed at the rotary drum 10, and a control unit 250 for controlling the whole operation of the ink-jet printer. As shown in FIG. 4, the rotary drum 10 is arranged near the center position within a housing 1. The tray 62 is arranged to project outwardly from the front portion of the housing 1 located at a position lower than the rotary drum 10. The paper cassette 72 is arranged below the rotary drum 10. The sheet feed-in mechanism 60 is arranged between the manual feed tray 62 and the paper cassette 72. The print head 200 is arranged behind the rotary drum 10. The sheet feed-out mechanism 160 is arranged behind the rotary drum 10 above the print head 200.

The rotary drum 10 is rotatably supported via a shaft 10S serving as a center axis, and has a sheet holding system 20 which holds and winds the paper sheet M on a peripheral surface 11 upon rotation. The rotational position of the rotary drum 10 is detected by a position sensor 101. The print head 200 is constituted by four nozzle units 200C, 200M, 200Y, and 200B arranged along the peripheral surface 11 of the rotary drum 10 to perform printing for the paper sheet M with yellow, magenta, cyan, and black inks, and receives these color inks from four ink supply sections 210 arranged apart from the print head 200. Each of the nozzle units 200C to 200B has ink-jet nozzles 207 aligned in the axial direction of the rotary drum 10 to spit a corresponding color ink on the paper sheet M. The sheet feed-in mechanism 60 has a loading roller unit 90 for loading the paper sheet M to the rotary drum 10 such that the width direction of the paper sheet M coincides with the axial direction of the rotary drum 10, a manual feeder 61 for picking up the paper sheet M from the manual feed tray 62 and feeding the paper sheet M to the loading roller unit 90 along a paper guide 60G, a cassette feeder 71 for picking up the paper sheet M from the paper cassette 72 and feeding the paper sheet M to the loading roller unit 90 along the paper guide 60G, and a feeder switching section 81 for driving one of the manual feeder 61 and the cassette feeder 71. The loading roller unit 90 is controlled to load the paper sheet M to the rotary drum 10 when the position sensor 101 detects that the rotary drum 10 rotates to a predetermined position. The paper sheet M is held on the peripheral surface 11 of the rotary drum 10 by the sheet holding system 20. The print head 200 performs color printing for the paper sheet M during rotation of the rotary drum 10.

After printing, the paper sheet M is separated from the peripheral surface 11 of the rotary drum 10 by a separation claw 141 of a sheet separator 140, and fed by the sheet feed-out mechanism 160 in a preset direction. A discharge switch 190 selectively guides the paper sheet M to one of a rear discharge tray 192 for discharging the paper sheet M with a printing surface facing upward, and an upper discharge tray 193 for discharging the paper sheet M with a printing surface facing downward.

The ink-jet printer further comprises an ink dryer 130 arranged near the rotary drum 10, and an ink dryer 181 arranged on the rear end side of the sheet feed-out mechanism 160. The ink dryer 130 is used to preheat the paper sheet M in order to facilitate charging and to dry the ink on the paper sheet M, for example. The ink dryer 181 is used to completely dry the ink on the paper sheet M.

The print head 200 is reciprocated by a head shifter section 110 at a high speed in the main scanning direction X parallel to the axial direction of the rotary drum 10, and moved by a head loader section 220 between a printing position adjacent to the peripheral surface 11 of the rotary drum 10 and a standby position remote from the printing position. When the print head 200 is at the standby position, each ink-jet nozzle 207 is covered with a cap 246 which prevents the ink from drying. The cap 246 is elevated by a cap elevator 240. The upper discharge tray 193 has discharge rollers 2R, and is openable as indicated by the chain double-dashed line in FIG. 4.

Figure 5:
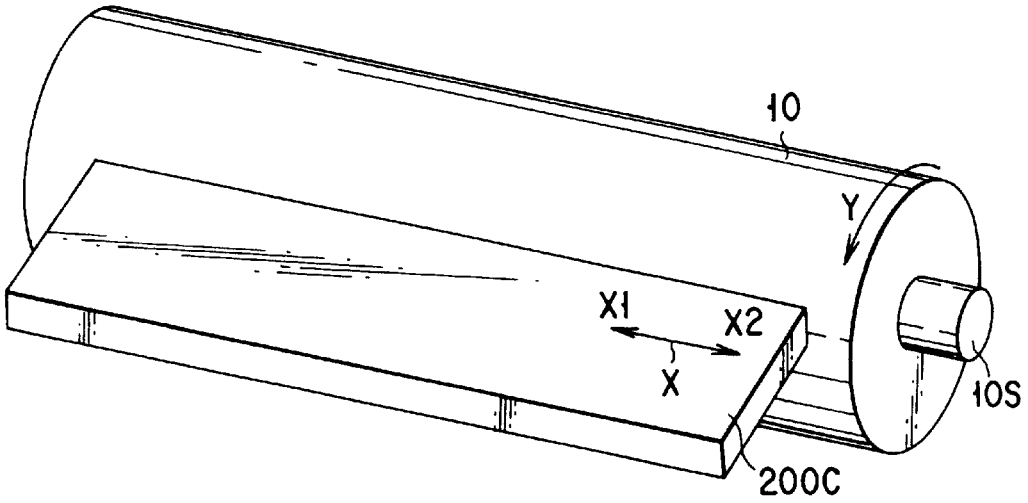
FIG. 5 is a perspective view showing the positional relationship between a rotary drum and a nozzle unit shown in FIG. 4.
Figure 6:
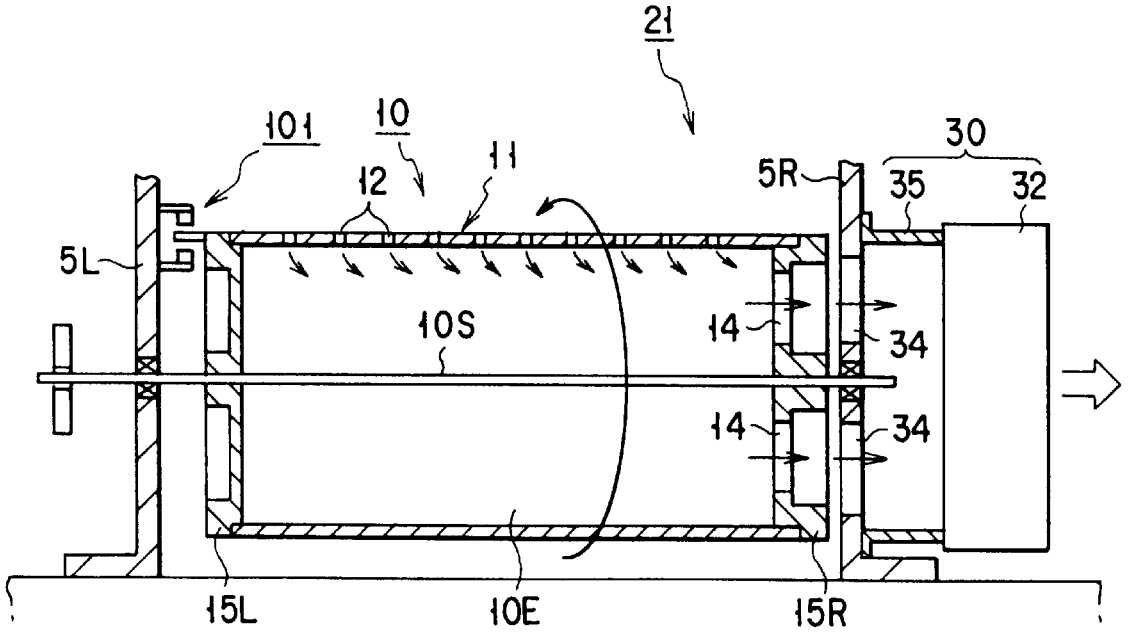
FIG. 6 is a sectional view showing the internal structure of the rotary drum shown in FIG. 4.

The rotary drum 10 holds the paper sheet M wound on the peripheral surface 11, and rotates to move the paper sheet M in the sub-scanning direction Y perpendicular to the main scanning direction X while facing the nozzle unit, as shown in FIG. 5. The rotary drum 10 is maintained at a constant revolution number of, e.g., 120 rpm, and rotates one revolution every 0.5 sec. Accordingly, 20 paper sheets can be successively printed per minute. More specifically, as shown in FIG. 6, the rotary drum 10 is rotatably supported by brackets 5L and 5R having bearings on the both sides of the shaft 10S, and rotated by the driving force of a main motor 93 transmitted to the shaft 10S via sprockets, timing belts, and gears. The main motor 93 is constituted by a servo motor, which has excellent quick-response and constant-speed characteristics. In this embodiment, the rotary drum 10 is constituted by a cylindrical frame of, e.g., an aluminum alloy, which has a hollow portion 10E and is electrically grounded. Since the diameter of the rotary drum 10 is set at 130 mm, a peripheral speed of 816 mm/sec=120 $\pi d/60$ is obtained. This peripheral speed can move the paper sheet M in the sub-scanning direction Y at a speed higher than in a conventional laser printer, and enhances natural drying of the ink. The peripheral surface 11 of the rotary drum 10 has a width of about 200 mm in the axial direction and a length of 408 mm ($=\pi d$) in the rotational direction. For this reason, the rotary drum 10 can satisfactorily holds an A4-size paper sheet M having a length of 297 mm and a width of 210 mm. A diameter d of the rotary drum 10 is preferably set to 100 mm or more in order to hold a paper sheet M in the A4 size or larger, and to obtain a peripheral speed capable of enhancing drying of the ink.

Figure 7:
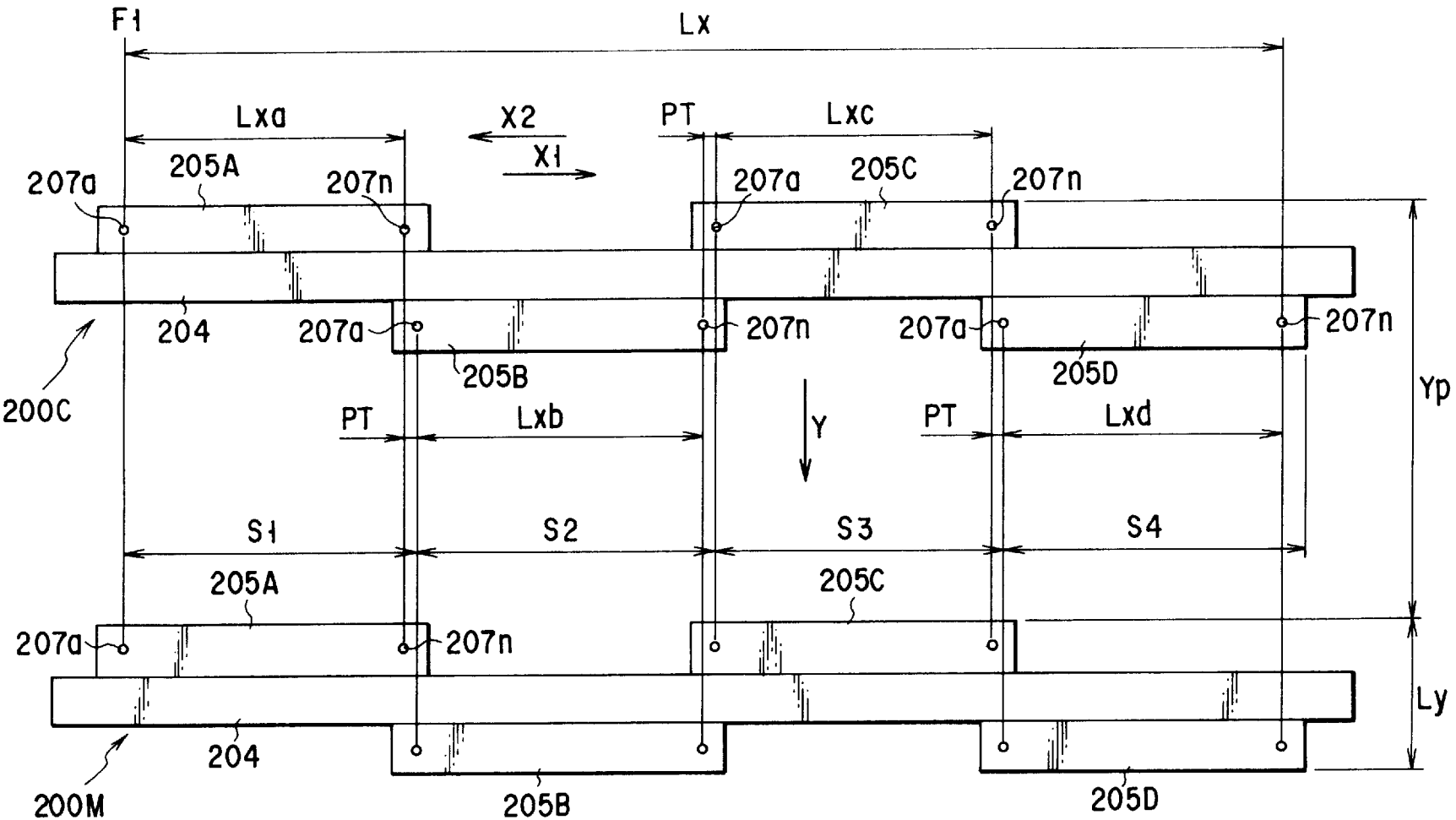
FIG. 7 is a view for explaining the structure of the nozzle unit shown in FIG. 4.

In the print head 200, each of the nozzle units 200C, 200M, 200Y, and 200B is formed of four nozzle unit segments 205A, 205B, 205C, and 205D integrally combined in consideration of technical and cost priorities, as shown in FIG. 7. The nozzle unit segments 205A to 205D are aligned in the main scanning direction X and deviated from each other in the sub-scanning direction Y corresponding to the rotational direction of the rotary drum 10. Lengths S1, S2, S3, and S4 of the nozzle unit segments 205A, 205B, 205C, and 205D are set equal to the value obtained by dividing the nozzle unit length in the main scanning direction X by the number of nozzle unit segments. That is, the nozzle unit segments 205A and 205C are disposed on the upper side of a coupling support bar 204 extending in the main scanning direction X and spaced apart from each other. The nozzle unit segments 205B and 205D are disposed on the lower side of the coupling support bar 204 and spaced apart from each other. The nozzle unit segments 205A to 205D are set to have a zigzag shape in which they are successively positioned in the main scanning direction X, with different levels in the sub-scanning direction Y. A ink-jet nozzle pitch PT is arbitrarily selectable. Thus, if the ink-jet nozzle pitch PT need not be small, each of the nozzle units 200C to 200B can be formed of ink-jet nozzles aligned in one line in the main scanning direction X, instead of the combined nozzle unit segments.

The nozzle unit segments 205A to 205D will be explained in more detail below. Each of the nozzle unit segments 205A to 205D is constituted by n ink-jet nozzles 207*a* to 207*n* aligned at the predetermined pitch PT. In this embodiment, segment lengths Lxa, Lxb, Lxc, and Lxd of the nozzle unit segments 205A to 205D are set to 2.11 inches. 159 ink-jet nozzles are aligned in the nozzle unit segments 205A to 205D at a pitch PT of 1/75 inch. The nozzle unit segments 205A to 205D have a height Ly of 9 mm in the sub-scanning direction Y. The last ink-jet nozzles 207*n* of the nozzle unit segments 205A and 205C, and the first ink-jet nozzles 207*a* of the nozzle unit segments 205B and 205D are spaced apart from each other by a pitch PT of 1/75 inch, like the pitch PT within each segment.

The nozzle units 200C, 200M, 200Y, and 200B are arranged along the peripheral surface 11 of the rotary drum 10 so as to perform printing in the order of cyan, magenta, yellow, and black, and spaced apart from each other by a pitch Yp preset at, e.g., 20 mm. Although the print head 200 is constituted by the nozzle units 200C, 200M, 200Y, and 200B for four colors, i.e., cyan, magenta, yellow, and black, four or more nozzle units may be arranged along the peripheral surface 11 of the rotary drum 10. Higher-quality, vivid color printing can be executed if two nozzle units are added for light red and blue, for example.

As shown in FIG. 4, the nozzle units 200C, 200M, 200Y, and 200B are attached to an attaching member 112 such that ink-jet nozzles having the same order form one column in the sub-scanning direction Y. The nozzle units 200C, 200M, 200Y, and 200B are moved by a reciprocating mechanism 111 of the head shifter section 110 together with the attaching member 112. For example, the ink-jet nozzle 207*a* of the nozzle unit segment 205A of the nozzle unit 200*c* is aligned at a column position F1 together with the ink-jet nozzles 207*a* of the nozzle unit segments 205A of the nozzle units 200M, 200Y, 200B, as shown in FIG. 7. Therefore, cyan, magenta, yellow, and black dots formed by the ink-jet nozzles 207 of the nozzle units 200C, 200M, 200Y, and 200B can accurately overlap in the main scanning direction X. Each of the ink-jet nozzles 207 of the nozzle unit 200B is set to have an orientation in which the locus of ink substantially coincide with the normal line of the peripheral surface 11 of the rotary drum 10. With this setting, the sizes and shapes of dots D in the respective colors formed on the paper sheet M on the rotary drum 10 are uniformed to maintain high printing quality. A gap between an outlet at the distal end of each ink-jet nozzle 207, and the rotary drum 10 is set at, e.g., 1 mm when the print head 200 is at the printing position.

Figure 8:
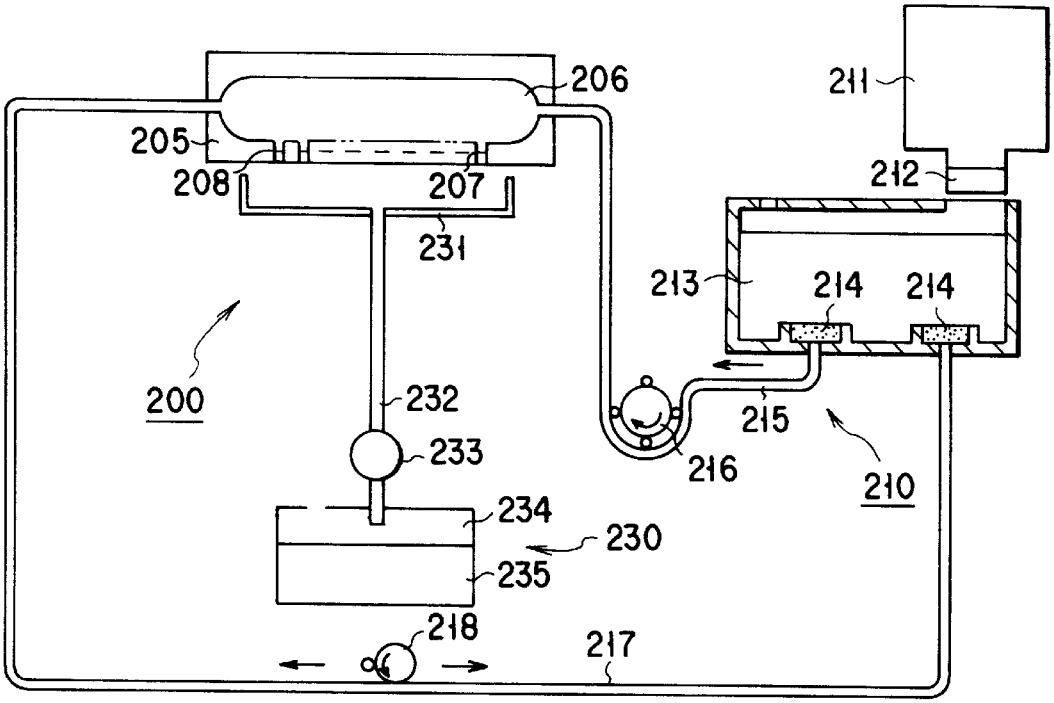
FIG. 8 is a view for explaining the structure of an ink supply section shown in FIG. 4.

As shown in FIG. 8, each ink supply section 210 is constituted by an ink tank 213 having filters 214, an ink cassette 211 detachable from the ink tank 213 via an ink leveling unit 212, an ink supply tube 215 for connecting a corresponding one of the nozzle units 200C, 200M, 200Y, and 200B to the ink tank 213, a pressurizing unit 216, an ink return tube 217, and a tube opening/closing unit 218. The ink cassette 211 is formed to supply 200 cc or more of ink which is a larger amount than a conventional amount of about 10 to 20 cc. When each pressurizing unit 216 is driven in a state where the ink return tube 217 is closed by the tube opening/closing unit 218, the color ink is supplied from the ink tank 213 to an ink buffer 206 of the nozzle unit, under pressure. At this time, if priming and spitting are performed, air near each nozzle can be vented, and clogging of each nozzle can be prevented. If the ink return tube 217 is opened, air in the ink buffer 206 can also be vented. If printing is performed in a state where the pressurizing unit 216 is stopped and the ink return tube 217 is opened by the tube opening/closing unit 218, the ink decreased by ink jet is automatically replenished from the ink tank 213 to the ink buffer 206 via the ink return tube 217 due to a capillary effect. The ink level in the ink tank 213 is always maintained by the ink leveling unit 212.

Figure 9:
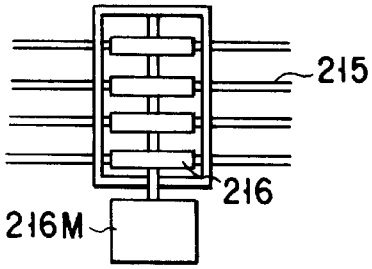
FIG. 9 is a plan view showing the structure of a pressurizing unit shown in FIG. 8.
Figure 10:
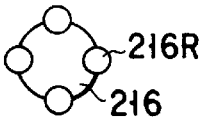
FIG. 10 is a side view showing the structure of the pressurizing unit shown in FIG. 8.

FIGS. 9 and 10 show the structure of the pressurizing unit 216. The pressurizing unit 216 is of a rotary type in which four press rollers 216R are rotated by a motor 216M. Upon rotation, these press rollers 216R press the ink supply tube 215 to supply the color ink to the nozzle unit side, under pressure. The tube opening/closing unit 218 is of a rotary type in which one press roller 218R rotates. The press roller may be replaced by a solenoid piece or the like.

At each ink supply section 210, a level difference between the ink level of the ink tank 213 and the ink outlet of a corresponding nozzle unit is exactly tuned in accordance with ink properties. This is performed to uniform ink-jet characteristics (meniscus) and stabilize high-quality printing. The ink tank 213 is disposed at a position lower than the ink outlet of a corresponding nozzle unit, and opened in the atmosphere during a printing operation.

Ejection control elements 208 are properly selected to cope with one of various ink-jet schemes. In this embodiment, each ejection control elements 208 is constituted by a piezoelectric actuator for ejecting a predetermined amount of ink using shear deformation of the ink-jet nozzle 207. In this case, an operation time of 0.1 msec (10 kHz) is required between completion of a dot printing and completion of the next dot printing. An ink-jet scheme such as electro-thermal conversion or electro-mechanical conversion may be employed.

In the above-described arrangement, since the large-capacity, heavy-weight, large-size ink tank 213 and ink cassette 211 can be disposed at a position remote from the print head 200, the nozzle unit segments 205 of the nozzle units 200C, 200M, 200Y, and 200B can be arranged closely in both the main scanning direction X and the sub-scanning direction Y to decrease the size and weight, as compared with a conventional ink-jet printer. Since the interval for exchanging the ink cassette becomes longer, the successive operation time of the printer can be greatly increased.

In this case, the print head 200 can be synchronously moved at a high speed with a light load in the main scanning direction X. The head shifter section 110 is formed of the reciprocating mechanism 111 and a motor unit 121 with a reciprocating rod 122 shown in FIGS. 4 and 11, and can rapidly, smoothly reciprocate in the main scanning direction X (X1, X2). The print head 200 is attached to the reciprocating mechanism 111 via the attaching member 112, and moved between the standby position and the printing position by the head loader section 220 shown in FIG. 4.

Figure 11:
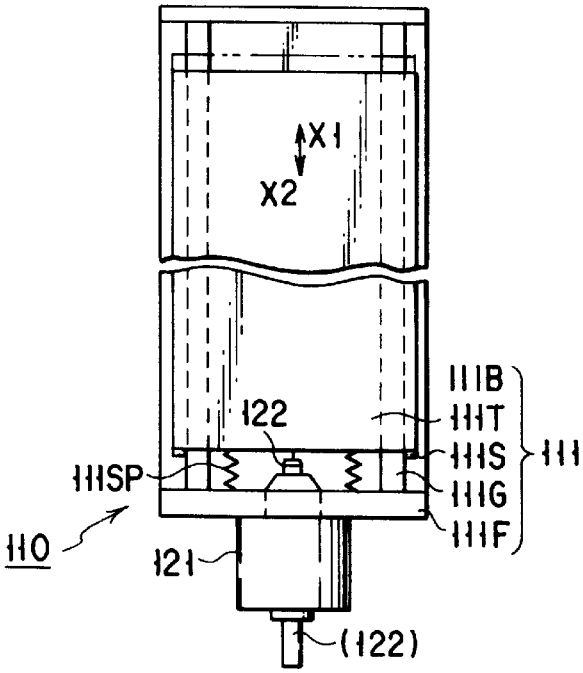
FIG. 11 is a view showing the structure of a head shifter section shown in FIG. 4.

As shown in FIG. 11, the reciprocating mechanism 111 has a base 111B, a pair of guide rails 111G attached to the base 111B, and a table 111T slidably mounted on the guide rails 111G. The table 111T is pressurized to the motor unit 121 side by a pair of springs 111SP and set at a predetermined position where a pair of stoppers 111S is generally in contact with a frame 111F. The motor unit 121 is fixed to and mounted on the frame 111F, and used to move the print head 200 fixed on the table 111T to a position indicated by the chain double-dashed line in a forward direction X1 against the pressure of each spring 111SP.

The motor unit 121 is constituted by a general stepping motor. However, a front bearing of the stepping motor has a screw structure in order to convert rotation of the motor into reciprocation of the rod 122. In this embodiment, a linear stepping actuator (SPS20E series available from COPAL CO., LTD.) is used.

More specifically, the reciprocating mechanism 111 uses the rotational force of the single motor unit 121 to drive the rod 122 such that the rod 122 is reciprocated upon change in the rotational direction of the motor unit 121. That is, the reciprocating mechanism 111 reciprocates the nozzle units 200C, 200M, 200Y, and 200B in the main scanning direction X (X1, X2) in synchronism with movement of the reciprocating rod 122. The print head 200 moves in the forward direction X1 during a color printing operation, and moves in a backward direction X2 after the color printing operation. With the above-mentioned structure, the timing belt and the like used in a conventional ink-jet printer can be eliminated, and noise can be reduced. The rotation speed of the motor unit 121 is variable, and is switched under the control of the control unit 250 to be higher in moving the print head 200 backward than in moving the print head 200 forward in order to further increase the printing speed.

Since the rotary drum 10 rotates two revolutions for a time interval from separation of a printed paper sheet M to suction of the next paper sheet M, the reciprocating mechanism 111 completes the backward movement within a time corresponding to the two revolutions, and awaits the next printing operation.

The motor unit 121 may be attached to a table moved by driving of the head loader section 220 below the table 111T, and coupled to the table 111T via a link mechanism. With this arrangement, the load of the motor unit 121 can be further reduced.

Figure 12:
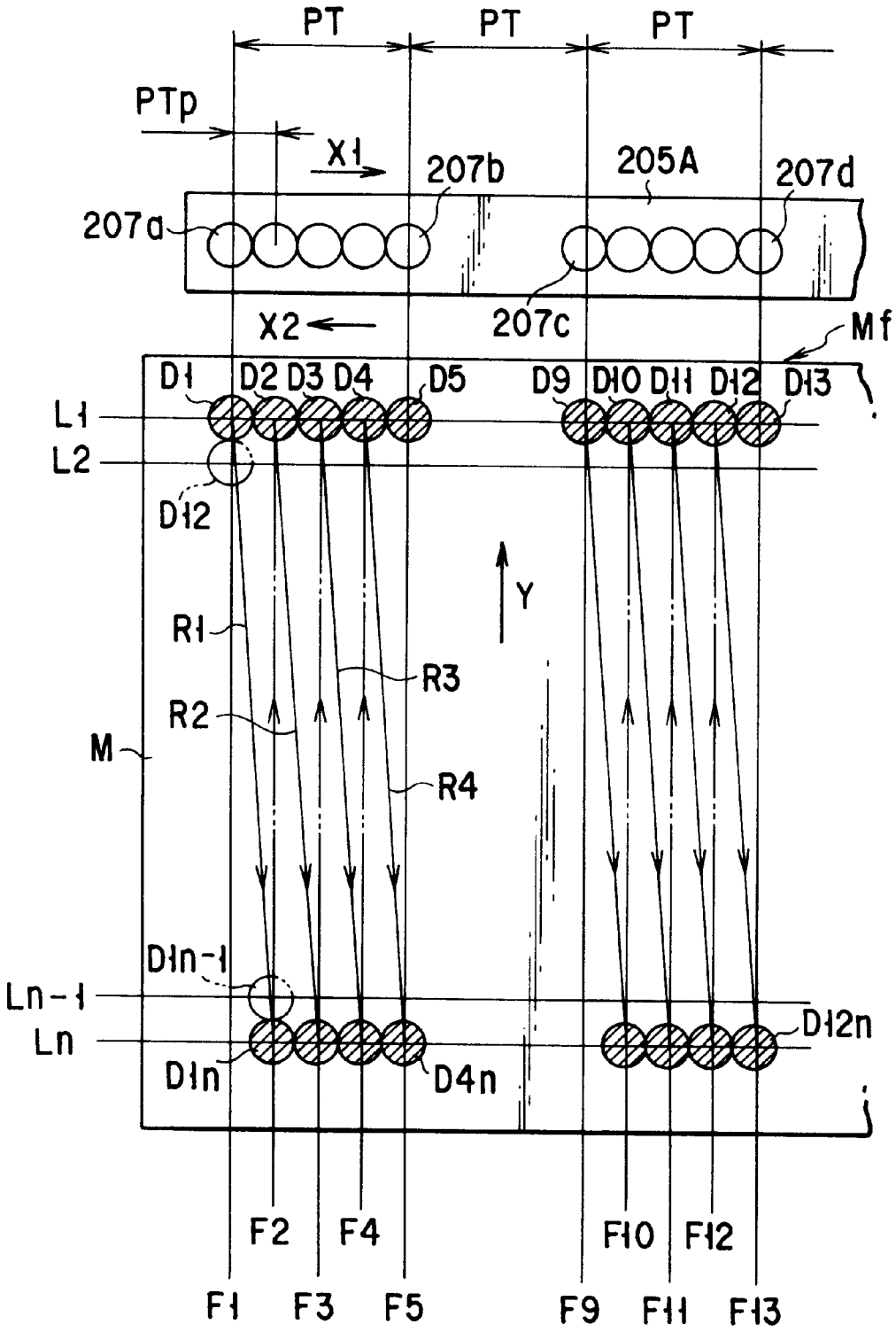
FIG. 12 is a view showing the printing position of an ink nozzle shown in FIG. 4.

As shown in FIG. 12, a printing operation is performed while the nozzle unit segments 205A, 205B, 205C, and 205D move in the forward direction X1 by the ink-jet nozzle pitch PT (=1/75 inch). Since only first dots D1 are printed within the lengths S1, S2, S3, and S4 of the nozzle unit segments 205A, 205B, 205C, and 205D shown in FIG. 12, the ink-jet nozzle 207 can operate within a time of 0.1 msec.

If the ink-jet nozzle 207 is repeatedly driven for, e.g., 3,000 dots in the sub-scanning direction Y, similar to a conventional ink-jet printer, the printing speed is difficult to abruptly increase. In this embodiment, the lengths S1, S2, S3, and S4 of the nozzle unit segments 205A, 205B, 205C, and 205D are determined to be 52.5 mm obtained by setting the nozzle unit length Lx in the main scanning direction X to 210 mm corresponding to the width of an A4-size paper sheet M and dividing the length Lx by the number N (=4) of nozzle unit segments. Giving attention to the first ink-jet nozzle 207*a* of the nozzle unit segment 205A, the ink-jet nozzle 207*a* prints dots D1, D2, D3, and D4 while it moves in the forward direction X1 by a distance corresponding to the ink-jet nozzle pitch PT (=1/75 inch). The rotary drum 10 rotates one revolution within 0.5 sec. Since the first ink-jet nozzle 207*a* advances from the column position F1 of the dot D1 to the column position F2 of the dot D2 by 1/300 inch within 0.5 sec, the rotary drum 10 rotates one revolution during this. Therefore, while the rotary drum 10 rotates one revolution, the ink-jet nozzle 207*a* prints n dots at a density of 300 dots/inch in the sub-scanning direction Y. In this manner, printing in the main scanning direction X and printing in the sub-scanning direction Y simultaneously progress. The remaining ink-jet nozzles also perform printing, similar to the ink-jet nozzle 207*a*.

In the above arrangement, each ink-jet nozzle 207 prints 4 dot lines while the rotary drum 10 rotates four revolutions. In other words, the nozzle unit segments 205A, 205B, 205C, and 205D print all dot lines which should be arranged within the lengths S1, S2, S3, and S4 while the rotary drum 10 rotates four revolutions. As a result, printing of the entire surface of the paper sheet M can be complete within 2 sec (=0.5 sec×4) required to rotate the rotary drum 10 through four revolutions. Even considering a time required to rotate the rotary drum 10 through two revolutions each for winding up a paper sheet before printing and for separating the paper sheet after printing, multi-color printing can be performed for one A4-size paper sheet at a speed as very high as 3 (=2+1) sec.

If the nozzle unit is moved in the forward direction X1 by 1/N (e.g., =8) the ink-jet nozzle pitch PT of each nozzle unit segment 205, and N (=8) revolutions of the drum are utilized, multi-color printing can be performed at a resolution (600 dots/inch) N (=8) times a resolution (=75 dots/inch) determined by the ink-jet nozzle pitch PT (=1/75 inch) in the prior art. That is, if the synchronous moving amount of the nozzle unit 205 in the forward direction X1, and the number N of drum revolutions are switched using high-speed rotation of the rotary drum 10 regardless of the size of the pitch PT between the ink nozzles, the resolution can be switched to a desired one, and the nozzle unit 205 can be manufactured at low cost without technical difficulties.

Further, there is a case where high-speed printing for paper sheet (surface) M is used to attain a predetermined resolution (e.g., 300 dots/inch). In this case, the ink-jet nozzle pitch PT may be set at 1/75 inch which is N (4) times a reference pitch PTp (1/300 inch) shown in FIG. 12 necessary for the predetermined resolution. The rotary drum 10 is rotated N (=4) revolutions, and the nozzle unit segment 205 is moved forward by the reference pitch PTp (1/300 inch) in the main scanning direction X1 while the rotary drum 10 rotates one revolution. Thus, multi-color printing at the predetermined resolution can be performed using the nozzle unit segment 205 for a resolution (75 dots/inch).

Figure 13:
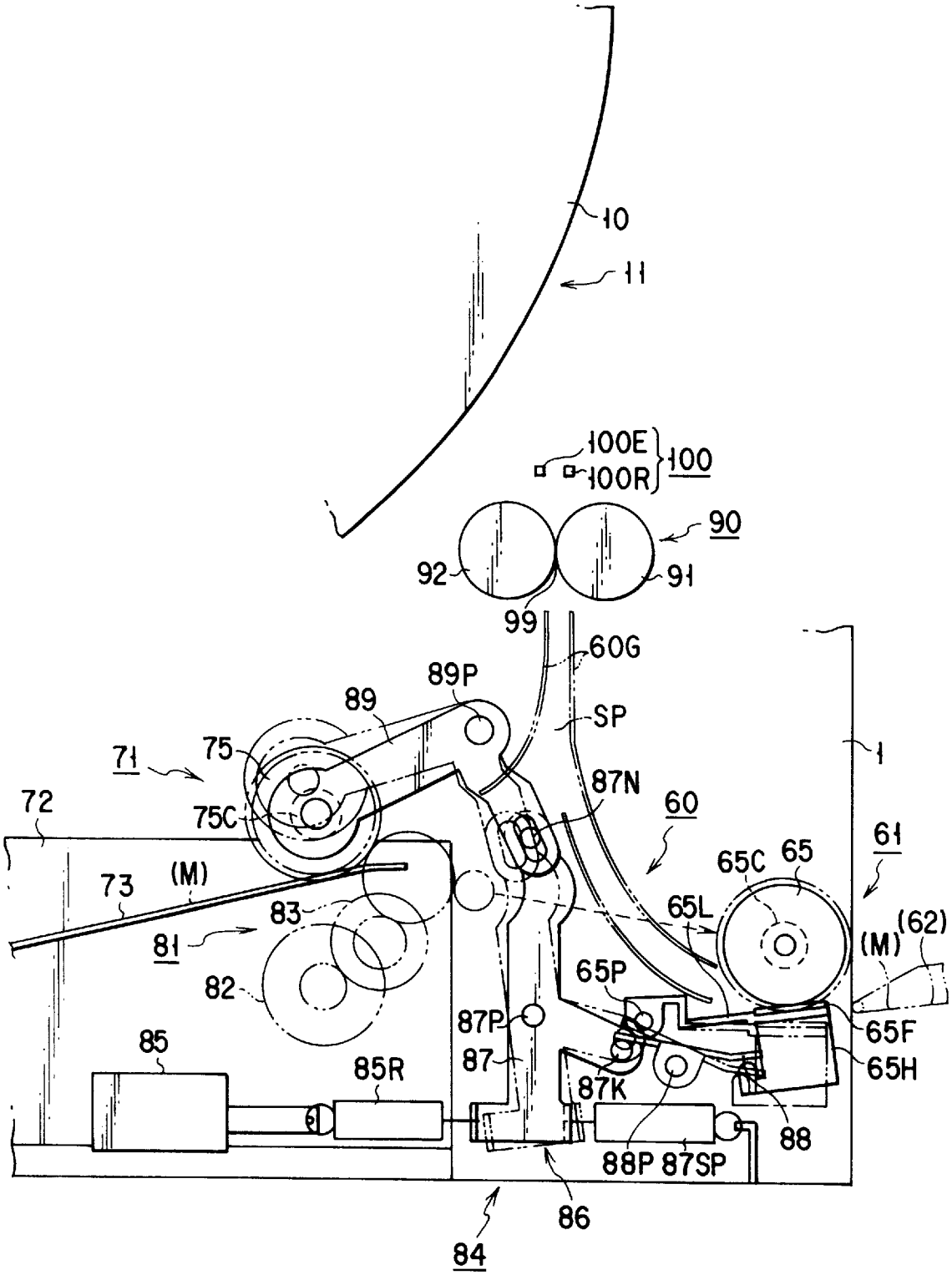
FIG. 13 is a view showing the structure of a sheet feed-in mechanism shown in FIG. 4 in detail.

As shown in FIGS. 4 and 13, the sheet feed-in mechanism 60 is used to feed paper sheets M to the loading roller unit 90 side one by one. The sheet feed-in mechanism 60 has the manual feed tray 62 openably mounted on a side part 3 of the housing 1, the manual feeder 61 for feeding a paper sheet M manually inserted into the manual feed tray 62 by using a feed roller 65, the cassette feeder 71 for feeding paper sheets M on a table 73 of the paper cassette 72 one by one by using a feed roller 75, and the feeder switching section 81 formed for selectively causing one of the feed rollers 65 and 75 to perform a feed operation. The cassette 72 is capable of storing 500 paper sheets M.

The feeder switching section 81 can switch the feed rollers 65 and 75 by changing the rotating force and rotational direction of a driving source. The driving source is obtained from a reversible motor 82 via a gear train 83. An active/idle state switching section 84 is arranged to switch both of the manual feeder 61 and the cassette feeder 71 into a selected one of an active state and an idle state.

More specifically, the feed roller 65 is rotated by a one-way clutch 65C when rotation of the motor 82 is set in one direction, and the feed roller 75 is rotated by a one-way clutch 75C when the rotation of the motor 82 is set in the opposite direction. The state switching section 84 is constituted by an actuator 85 and a switching mechanism 86. The switching mechanism 86 is constituted by a lever 87 having a pin 87P and an engaging pin 87K, a lever 88 having a pin 88P, a lever 89 having a pin 89P, and the like. The actuator 85 switches the positions of the feed roller 75 and a friction plate 65F. The feed roller 75 is arranged above the paper sheet M supported by the table 73, and is set in the idle state when separating from the paper sheet M and in the active state when coming close to the paper sheet M. The friction plate 65F is disposed at a position corresponding to the feed roller 65 below the paper sheet M, and is set in the idle state when separating from the paper sheet M and in the active state when coming close to the paper sheet M. The friction plate 65F is operated via a pin 65P of a holder 65H.

As shown in FIGS. 4 and 13, the loading roller unit 90 is constituted by at least a pair of loading rollers 91 and 92 extending in the axial direction of the drum, and is used to load each paper sheet M fed from the cassette feeder 61 and 71 sides to the rotary drum 10 at a predetermined timing. The supply speed of the paper sheet M is set at a speed corresponding to the peripheral speed of the rotary drum 10. Each of the feeder 61 and 71 feed a paper sheet M picked up from a corresponding one of the cassette and the manual feed tray via the merging point of a paper guide 60G, and strikes (abuts) a leading end Mf (see FIG. 12) of the paper sheet M against a contact 99 between the loading rollers 91 and 92 set in a standstill state. Since the contact 99 forms a straight line extending in the axial direction of the rotary drum 10, even if the paper sheet M is slanted when the leading end Mf of the paper sheet M collides against the contact 99, the posture of the paper sheet M is corrected along this straight line. At the merging point, the paper guide 60G has a bend accepting space SP for accepting the bend of the paper sheet M. That is, the feed amount of the feed roller 65 for one paper sheet M is set slightly longer than the distance between the feed roller 65 and the loading roller unit 90. Similarly, the feed amount of the feed roller 75 for one paper sheet M is also set slightly longer than the distance between the feed roller 75 and the loading roller unit 90. This is for positively generating elastic deformation on the surface of the paper sheet M, and pressing the leading end Mf of the paper sheet M against the contact 99 more strongly by the elastic force to reliably correct the posture.

At least one of the loading rollers 91 and 92 receives a rotating force applied from the main motor 93 constituting a feed force applying section together with a gear train, a clutch, and the like. The main motor 93 drives the loading rollers 91 and 92 under the control of the control unit 250, and feeds the paper sheet M to the rotary drum 10 side by an amount corresponding to the elastic deflection. The loading rollers 91 and 92 feed the paper sheet M until the leading end Mf is sensed by a sensor section 100 shown in FIG. 13, and then stop. At this time, the loading rollers 91 and 92 bite the leading end Mf side of the paper sheet M and are set in a standby state.

The state switching section 84 operates during this standby state to separate the feed roller 75 from the paper sheet M and separate the friction plate 65F from the feed roller 65. In this manner, the paper sheet M is released, so that the loading roller unit 90 can feed the paper sheet M anytime. With this operation, the next paper sheet M can be completely prevented from being erroneously fed.

That is, the control unit 250 inhibits application of a rotating feed force until the posture of the paper sheet M is corrected, and permits application of the rotating feed force upon completion of correction of the position. More specifically, the control unit 250 performs time management with the feed operation of the sheet feed-in mechanism 60 in order to feed the paper sheet M to the rotary drum 10 side without any slant. The feed drive force may be obtained from the motor 82.

The control unit 250 performs timing adjustment with respect to the rotary drum 10 side. In adjusting the timing, when the rotational position of the rotary drum 10 detected by the position sensor 101 including light-emitting and light-receiving elements shown in FIG. 4 reaches a preset position, the loading roller unit 90 is driven by a driving force from the main motor 93 to feed the paper sheet M to the rotary drum 10.

The sheet holding system 20 is used to hold the paper sheet M on the peripheral surface 11 of the rotary drum 10. Negative-pressure suction holding, electrostatic attraction holding, mechanical holding, and the like are properly selected. In this embodiment, electrostatic attraction holding is employed to hold a paper sheet M, and negative-pressure suction holding and mechanical holding are employed as assistance.

More specifically, electrostatic attraction holding is performed by a charger 51 of a charging roller scheme shown in FIG. 4. The paper sheet M is charged by positive charges, and held on the peripheral surface 11 using an electrostatic attraction force created between the paper sheet M and the grounded rotary drum 10.

To reduce the load in attraction, the nip of the loading rollers 91 and 92 are opened. The charger 51 is formed to be separable from the peripheral surface 11 of the rotary drum 10 upon completion of attraction of the paper sheet M to the rotary drum 10. With this structure, the charger 51 can be prevented from contacting an ink image formed on the paper sheet M and disturbing the image.

To increase the charging efficiency by the charger 51, the ink dryer 130 is used to forcibly preheat the paper sheet M to be supplied to the rotary drum 10.

More specifically, the ink dryer 130 is employed to improve a long ink drying time which is a factor of increasing the printing speed in a conventional ink-jet printer, and is made up of a heat source 131 and a warm air fan 132 which are disposed near the periphery of the rotary drum 10 as shown in FIG. 4. Printed ink is dried by direct or indirect heating of the paper sheet M with a blow of air supplied from the outside and warmed by the heat source 131. Part of the warm air flows between the loading roller unit 90 and the charger 51, so that the paper sheet M can be forcibly preheated before being supplied to the rotary drum 10. This preheating enhances contact of ink on the paper sheet M.

A supplemental charger 53 is arranged to allow supplement of an electrostatic attraction force by a decreased amount along with execution of color printing by ink jet. The charger 51 may also serve as the supplemental charger 53. In this case, the charger 51 is formed to be variable in charging ability. The charging ability of the charger 51 is switched to be high while the rotary drum 10 rotates one revolution in the direction Y after start of loading the paper sheet M, and to be low upon one revolution. The charger 51 in this case must be of a non-contact type such as a corona charger which does not contact the paper sheet M on the rotary drum 10.

Attraction charges are removed by a discharger 55 upon completion of color printing. In contrast to the charger 51, negative charges are applied.

A negative-pressure suction holding section 21 serving as assistance is formed to be capable of creating a negative pressure in the rotary drum 10 by a negative-pressure creating section 30 and holding the paper sheet M by applying the negative-pressure to the paper sheet M via many suction holes 12 which extend through the rotary drum 10 in the radial direction to communicate with the internal and external spaces. In addition, the paper sheet M can be held even if the master-slave relationship with the charger 51 is exchanged.

As shown in FIG. 6, the negative-pressure creating section 31 is formed of a suction port 34 facing a suction port 14 on the rotary drum 10 side, and a suction fan 32 for sucking the air from the suction port 34 via a duct 35 in order to create a negative pressure in the drum (hollow portion 10E). The suction port 14 is formed in the end-surface plate 15R of the rotary drum 10, and the suction port 34 is fixedly formed in the bracket 5R in the housing 1. Therefore, the end-surface plate 15R of the rotary drum 10 and the bracket 5R of the negative-pressure creating section 30 do not contact each other though they come close to each other in the axial direction of the drum. Therefore, the rotation load of the rotary drum 10 can be reduced. A gap from the end-surface plate 15R is useful for suppressing variations in load of the suction fan when the paper sheet M is sucked by a negative pressure or not. An end-surface plate 15L is a blind plate.

In this embodiment, the suction holes 12 are formed at positions where only the leading end side of the paper sheet M is sucked. However, the suction holes 12 may be formed at positions where only the trailing end side of the paper sheet M or both the leading and trailing end sides can be sucked. Further, the suction holes 12 may be uniformly formed in the whole peripheral surface 11 of the drum.

Figure 14:
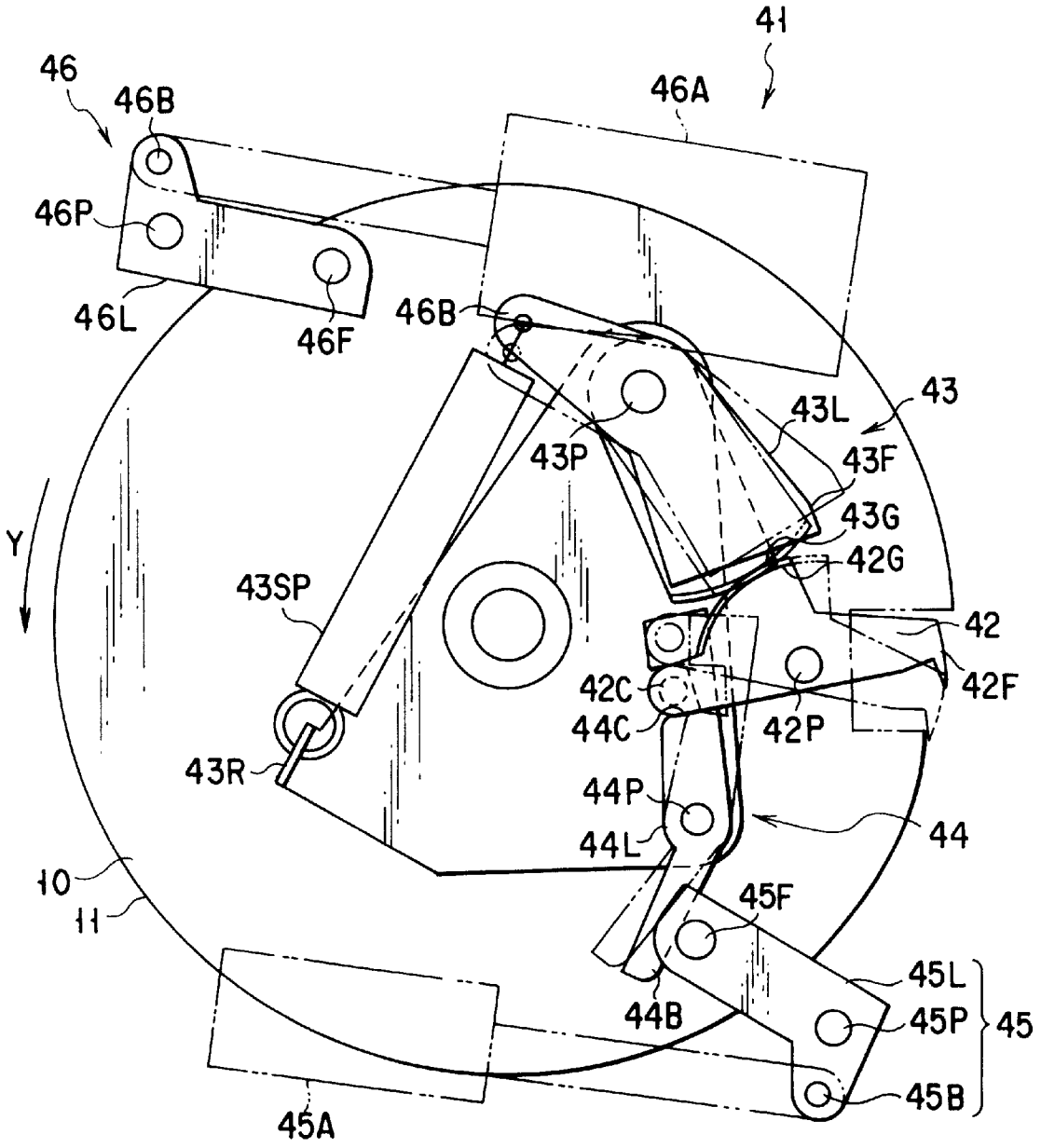
FIG. 14 is a view showing the sheet locking state of the rotary drum shown in FIG. 4.
Figure 15:
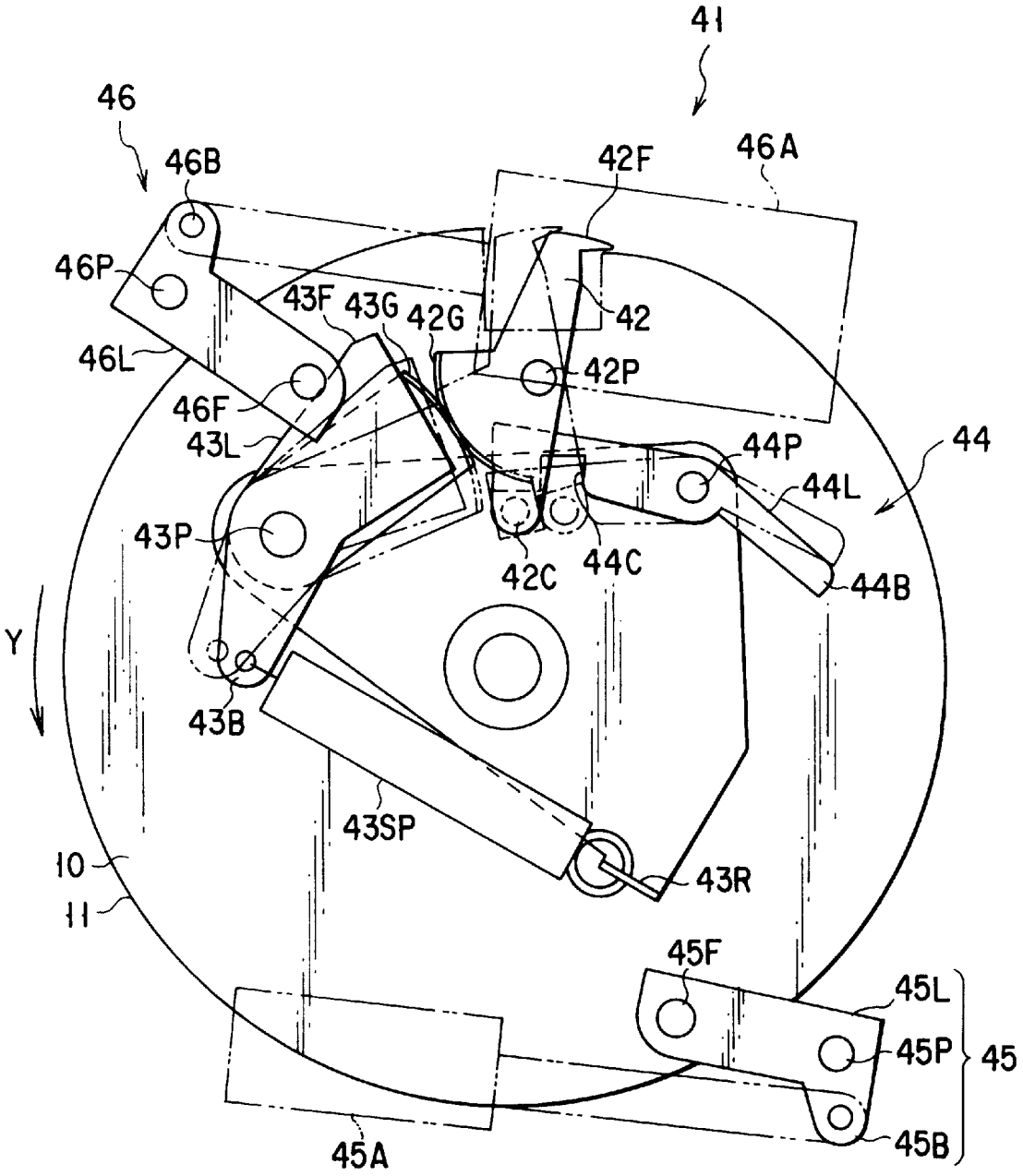
FIG. 15 is a view showing the sheet releasing state of the rotary drum shown in FIG. 4.

As shown in FIGS. 14 and 15, a clamp claw holding unit 41 for mechanical holding clamps the peripheral part of the fed paper sheet M. In this embodiment, the clamp claw holding section 41 is formed to clamp the leading end side of the paper sheet M with a clamp claw 42 to the rotary drum 10.

More specifically, the clamp claw holding section 41 is constituted by the clamp claw 42, a normally clamping mechanism 43, a normally release locking mechanism 44, an unlocking mechanism 45, and a lock resuming mechanism 46. The clamp claw 42, the normally clamping mechanism 43, and the normally release locking mechanism 44 are mounted on one end side of the rotary drum 10, which is movable. The unlocking mechanism 45 and the lock resuming mechanism 46 are attached to a bracket (not shown) in the housing 1, which is not movable. The unlocking mechanism 45 and the lock resuming mechanism 46 is associated with the normally clamping mechanism 43 and the normally release locking mechanism 44 to control clamping and releasing operations of the clamp claw 42 by properly using rotation of the rotary drum 10.

The clamp claw 42 has, an engaging portion 42C, and a sector gear 42G, and is pivotally attached to a pin 42P. The normally clamping mechanism 43 is made up of a lever 43L (proximal end portion 43B and distal end portion 43F) pivoted about a pin 43P, a sector gear 43G which is arranged at the distal end portion 43F and meshes with the sector gear 42G, and a spring 43SP hooked between the proximal end portion 43B and a fixing portion 43R. The normally clamping mechanism 43 normally keeps the clamp claw 42 in a clamping state indicated by the chain double-dashed line in FIG. 14 by using the tension applied from the spring 43SP.

The normally release locking mechanism 44 is made up of a lock lever 44L pivoted about a pin 44P. An engaging groove 44C of the lock lever 44L is formed to be engageable/separable with/from the engaging portion 42C of the clamp claw 42. By engaging the engaging groove 44C and the engaging portion 42C, the clamp claw 42 can be normally locked in a clamp releasing state indicated by the solid line.

The unlocking mechanism 45 is made up of a lever (distal end portion 45F and proximal end portion 45B) 45L pivotal about a stationary pin 45P, and an actuator 45A. When the actuator 45A rotates the lever 45L clockwise about the pin 45P, the distal end portion 45F made up of a pin engages with a proximal end portion 44B of the lock lever 44L which is moved in accordance with rotation of the rotary drum 10. Then, the lock lever 44L pivots clockwise to disengage from the engaging portion 42C of the clamp claw 42. Accordingly, the clamp claw 42 becomes in a clampable state by the urging force applied from the spring 43SP. That is, the normally release locking state can be canceled.

As shown in FIG. 15, the lock resuming mechanism 46 is made up of a lever (distal end portion 46F and proximal end portion 46B) 46L pivotal about a stationary pin 46P, and an actuator 46A. When the actuator 46A rotates the lever 46L clockwise about the pin 46P, the lever 43L which is moved in accordance with rotation of the rotary drum 10 can press the distal end portion 46F of the lever 46L that is made up of a pin, and set the clamp claw 42 in a clamp releasing state indicated by the chain double-dashed line via the sector gears 43G and 42G. Accordingly, the engaging portion 42C of the clamp claw 42 engages with the engaging groove 44C of the lock lever 44L (44F). That is, the normally clamp locking state of the clamp claw 42 can be resumed.

In this embodiment, one revolution (0.5 sec) of the rotary drum 10 is assigned to an operation of loading the paper sheet M to the rotary drum 10 by the loading roller unit 90 and holding the paper sheet M on the rotary drum 10 by the sheet holding system 20.

A color-printed paper sheet M can be separated from the peripheral surface 11 of the rotary drum 10 by the sheet separator 140 including the separation claw 141 shown in FIG. 4 which is capable of being inserted to break a contact between the rotary drum 10 and the paper sheet M. During a printing operation, the separation claw 141 is set apart from the rotary drum 10. The control unit 250 is constituted to adjust the separation timing such that the sheet separator 140 is synchronized with the sheet holding system 20 (21, 41).

More specifically, the control unit 250 controls separation of the paper sheet M by causing the holding force of the sheet holding system 20 (21, 41) to be removed at a predetermined timing suitable for a separating operation of the sheet separator 140, and then causing the separation claw 141 to be inserted between the paper sheet M and the peripheral surface 11 of the rotary drum 10. By a link mechanism (not shown), the separation claw 141 can be set apart from the peripheral surface 11 of the rotary drum 10 by a link mechanism (not shown) during color printing, and set close to the peripheral surface 11 at the time of separation. After the separation, the separation claw 141 delivers the paper sheet M to the sheet feed-out mechanism 160 side. The paper sheet may be delivered by a structure formed independently of the separation claw 141 so as to positively deliver the paper sheet M to the sheet feed-out mechanism 160 side by using, e.g., an air pressure, a vacuum force, or a mechanical force.

One revolution (0.5 sec) of the rotary drum 10 is assigned to an operation of releasing the holding force of the paper sheet M and separating the paper sheet M from the rotary drum 10 by using the control unit 250, the sheet holding system 20, and the sheet separator 140. As shown in FIG. 4, the charger 51, the supplemental attraction charger 53, the discharger 55, and the sheet separator 140 are spaced from each other and arranged in this order from the upper stream side to the down stream side in the rotational direction Y of the rotary drum 10, thereby smoothing charge-printing-separation.

Figure 16:
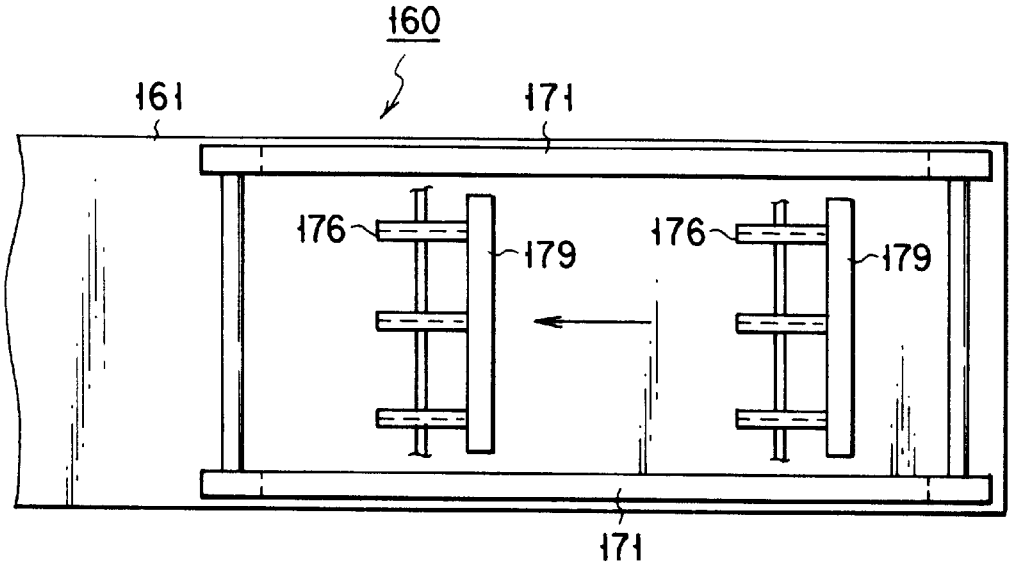
FIG. 16 is a plan view showing the structure of a sheet feed-out mechanism shown in FIG. 4.
Figure 17:
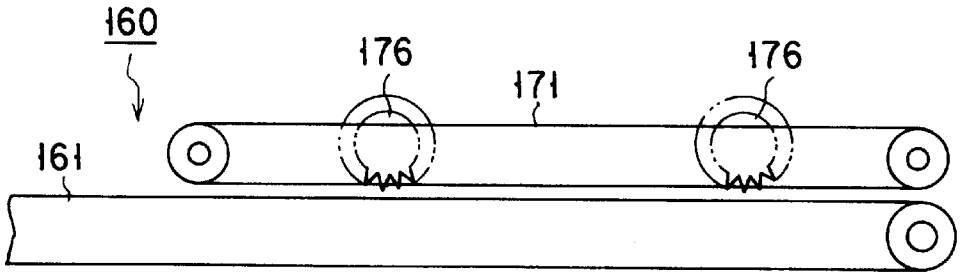
FIG. 17 is a side view showing the structure of the sheet feed-out mechanism shown in FIG. 4.
Figure 18:
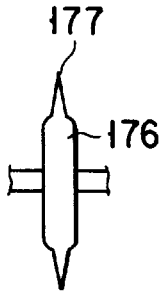
FIG. 18 is a front view of a wheel shown in FIGS. 16 and 17.

The sheet feed-out mechanism 160 is used to feed out the separated paper sheet M in a predetermined direction. In this embodiment, as shown in FIGS. 16 to 18, the sheet feed-out mechanism 160 includes a belt conveyor 161 formed in contact with the non-printing surface side (rear surface) of the paper sheet M, and a paper press section for pressing the paper sheet M against the belt conveyor 161. Therefore, the printed paper sheet M can be smoothly discharged in a desired direction. As shown in FIGS. 16 and 17, the belt conveyor 161 can feed the separated paper sheet M at a speed corresponding to the peripheral speed of the rotary drum 10. After the trailing end of the paper sheet M is separated from the rotary drum 10, the speed of the belt conveyor 161 can be changed to a low speed so as to feed the paper sheet M in the longest time which do not cause any influence to color printing of the next paper sheet M. With this arrangement, natural drying of the ink can be further enhanced. For this purpose, the length of the belt conveyor 161 is set greater than the length of an A4-size paper sheet.

The paper press section includes press belt conveyors 171 formed in contact with printing inhibition areas which are positioned on the two sides of the printing surface of the paper sheet, and so-called star wheels 176 (see FIG. 18) which do not contact with the paper sheet M in a normal state, and contact with the paper sheet M upon a warp thereof to prevent the paper sheet M from rising. Cleaning sections 179 are made of a sponge or a felt, and used to clean an ink attached to each contact portion 177 of the star wheel 176.

The ink dryer 181 shown in FIG. 4 is arranged to face the belt conveyor 161 at the terminal side of the belt conveyor 161 in order to completely dry the ink on the printing surface of the paper sheet M fed thereto, by direct or indirect heating of the paper sheet M. The discharge switch 190 causes the color-printed paper sheet M to be discharged to the discharge tray 192, openably mounted on a side part 4 of the housing 1 similarly to the manual feed tray 62, with printing surface facing upward or the upper discharge tray 193 with the non-printing surface facing upward. That is, the discharge switch 190 can select one of two directions corresponding to the discharge trays 192 and 193 to discharge the paper sheet M. The discharge switch 190 may be modified to select three or more directions.

Upon completion of color printing, the head loader section 220 moves the nozzle units 200C, 200M, 200Y, and 200B of the print head 200 to the standby position apart from the printing position adjacent to the peripheral surface 11 of the rotary drum 10. After the print head 200 reaches the standby position, the cap elevator 240 moves up the cap 246 to cover each ink-jet nozzle 207, thereby preventing the ink from drying. The cap 246 is made of an elastic deformable seal member shown in FIG. 19 (e.g., a hollow cylindrical member made of a synthetic rubber), and can press the outlet at the distal end of each ink-jet nozzle 207. Accordingly, each ink-jet nozzle 207 can be reliably sealed even if it must be set on the normal line of the rotary drum 10.

Figure 19:
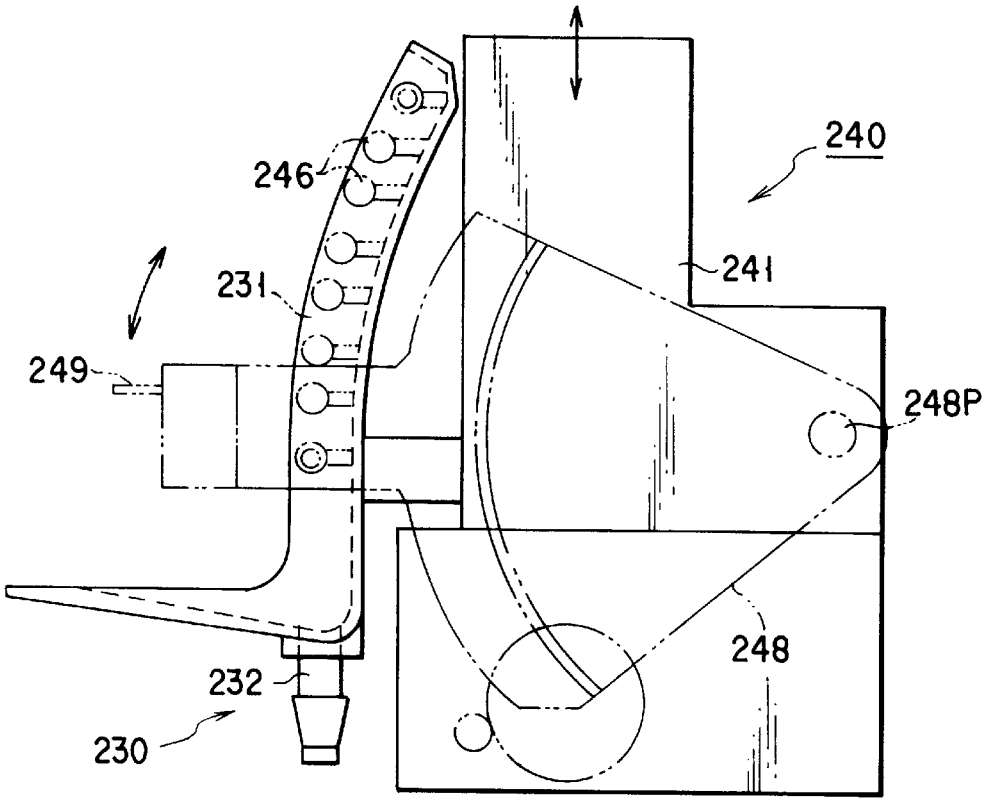
FIG. 19 is a view showing the structure of a cap elevator shown in FIG. 4.
Figure 20:
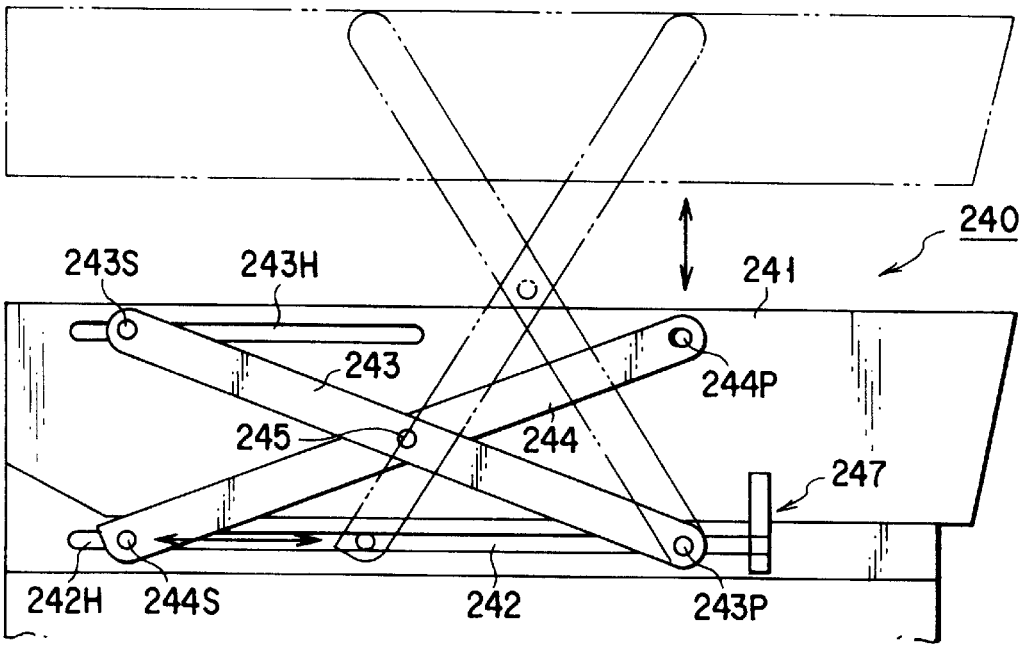
FIG. 20 is a view showing the structure of an elevation frame shown in FIG. 19.

As shown in FIG. 4, the head loader section 220 comprises a rack 221 arranged on a table having the reciprocating mechanism 111 of the head shifter section 110, and a pinion 222 which is rotatably mounted on a bracket in the housing 1 and meshes with the rack 221. As shown in FIGS. 19 and 20, the cap elevator 240 is constituted by one link bar 243 having a proximal end pivotal about a pin 243P and a distal end slidable in a guide groove 243H via a slide pin 243S, another link bar 244 having a proximal end slidable in a guide groove 242H via a slide pin 244S and a distal end pivotal about a pin 244P, a screw shaft 242 rotated by a gear 247, and the like. The middle portions of the link bars 243 and 244 are rotatably coupled by a pin 245. If the screw shaft 242 is rotated, an elevation frame 241 can be elevated.

A waste ink tray 231 having the caps 246 attached thereto is fixed and mounted on the elevation frame 241. That is, when the print head 200 is moved by the head loader section 220 in a direction to be spaced apart from the rotary drum 10 in FIG. 4, the cap elevator 240 moves up the caps 246. The head loader section 220 further moves the print head 200 in a direction to come close to the rotary drum 10, and stops it when the ink-jet nozzles 207 set in contact with the caps 246. That is, the ink-jet nozzles 207 can be covered with the caps 246. A wiper blade 249 shown in FIG. 19 is pivoted by a pivotal member 248 having a support shaft 248P as a center, and cleans the ink-jet nozzles 207 before the caps 246 cover the ink-jet nozzles 207.

A waste ink collecting unit 230 is constituted by the waste ink tray 231 shown in FIG. 8, a waste ink tube 232, a waste ink pump 233, and a waste ink tank 234 including a sponge 235. The waste ink collecting unit 230 can collect ink spitted by driving the ejection control elements 208, and ink primed by increasing the internal pressure of the ink buffer 206 in the nozzle unit segment 205.

The control unit 250 shown in FIG. 4 is formed of a computer including a CPU, a ROM, a RAM, and the like, and performs printing control, loading roller driving control, paper loading timing adjustment control, rotation speed switching control, separation timing adjustment control, and the like.

The operation of the above-described ink-jet printer will be described below.

The rotary drum 10 is rotated by the main motor 93 in the direction Y at a constant peripheral speed (rotation speed). When one paper sheet M is fed from, e.g., the cassette feeder 71 (or manual feeder 61) which is selected using the feeder switching section 81 serving as a part of the sheet feed-in mechanism 60, the leading end Mf is struck against the contact 99 between the two loading rollers 91 and 92 of the loading roller unit 90 so as to correct the posture of the paper sheet M. A bend of the paper sheet M present in the bend accepting space SP enhances the correction ability.

After the posture of the paper sheet M has been corrected such that it can be supplied to the rotary drum 10 without being slanted, the control unit 250 enables application of a rotating feed force. Thus, the loading rollers 91 and 92 bite the leading end Mf of the paper sheet M and become in the standby state. Then, the state switching section 84 operates to set the sheet feed-in mechanism 60 into the idle state.

When it is detected by the position sensor 101 that the rotational position of the rotary drum 10 reaches a predetermined position, the control unit 250 enables the loading rollers 91 and 92 of the loading roller unit 90 to feed the paper sheet M to the rotary drum 10 side. At this time, the paper sheet M is feed at a speed corresponding to the peripheral speed of the rotary drum 10.

The negative-pressure suction holding section 21 serving as assistance sucks to hold the paper sheet M by a negative pressure created in the rotary drum 10 by the negative-pressure creating section 31. At the same time, the mechanisms 45 and 43 of the clamp claw holding section 41 operate the clamp claw 42 to clamp the leading end portion of the paper sheet M to the peripheral surface 11 of the rotary drum 10. Thereafter, the charger 51 charges the paper sheet M. Before this charging, the ink dryer 130 dries the paper sheet M by forcible preheating. Since the paper sheet M can be efficiently charged, the paper sheet M can be reliably held by electrostatic attraction at a predetermined position in the direction Y on the peripheral surface 11 of the drum.

Since the leading end portion of the paper sheet M is held by negative-pressure suction before being clamped by the clamp claw 42, the paper sheet M can be stably clamped. In addition, the nip pressure between the loading rollers 91 and 92 is released to improve the precision of the holding position in the rotary drum 10.

The control unit 250 performs a control of driving the nozzle unit segments 205A, 205B, 205C, and 205D of the nozzle units 200C, 200M, 200Y, and 200B to simultaneously print dots D1, D5, D9, . . . at a row position L1 shown in FIG. 12 within the range of the segment lengths S1, S2, S3, and S4. The ink-jet nozzles 207*a* to 207*n* of the nozzle units 200C, 200M, 200Y, and 200B are arranged at the same position in the direction X1, e.g., the dot D1 is printed with accurately overlapped four color inks.

The head shifter section 110 synchronously moves the nozzle units 200C, 200M, 200Y, and 200B in the forward direction X1 shown in FIG. 4. At this time, they move at a constant speed from the dot D1 to the dot D2. During this period, the ink-jet nozzles 207 are driven under the control of the control unit 250. Thus, N dots D1 to D1n are printed at the column position F1 in accordance with rotation of the rotary drum 10. The nozzle unit segments 205 perform printing simultaneously.

Upon one revolution of the rotary drum 10, the dots D1 to D1n belonging to the column position F1 can be color-printed on a virtual locus R1 shown in FIG. 12. Similarly, dots D2 to D2n belonging to the column position F2 are printed on a virtual locus R2 while the nozzle unit 200C, 200M, 200Y, and 200B are moved from the dot D2 to the dot D3. That is, while the ink-jet nozzles 207*a* are moved in the direction X1 by the predetermined pitch PT, planes [(L1, L2, . . . , Ln)×(F1, F2, . . . , F4)] defined by the row L and the column F can be simultaneously scanned to perform multi-color printing for an A4-size paper sheet within 2 sec. Even if a time corresponding to two revolutions (1 sec) assigned to hold and separation of the paper sheet M is added, printing is completed within 3 sec or less.

Regardless of the size (PT, PTp) of the pitch between the ink-jet nozzles 207, color printing at a desired resolution can be performed by selectively changing the moving amount of the print head 200 in the direction X and the number N of revolution of the rotary drum 10. Further, the pitch PT (=1/75 inch) N (=4) times larger than the predetermined reference pitch PTp (=1/300 inch) is available to perform color printing at a resolution (300 dots/inch) corresponding to the reference pitch PTp.

With reference to FIG. 12, although the positions of the dots D1 and D1n are deviated from each other in the direction X1 by an amount for one dot, the amount of deviation is 1/300 inch for a resolution of 300 dots/inch, so this deviation cannot be observed with the naked eye.

If the moving amount in the direction X1 is set constant, and the nozzle is controlled to reach the position of the dot D2 after the rotary drum 10 is rotated through one revolution and returned to the row position L1 again upon printing the dot D1, the amount of deviation between the dot D1 and the dot D1n in the direction X1 can be decreased smaller than one dot.

In color printing, the ink on the paper sheet M is positively, quickly dried by the ink dryer 130 in addition to the ambient air flow relative to the paper sheet M on the rotary drum rotating at a high speed, so that high printing quality can be maintained.

After printing one paper sheet, the head shifter section 110 synchronously moves the print head 200 in the backward direction X2 by the predetermined pitch PT at a high speed, in preparation for the next printing.

Concurrently, the control unit 250 causes the holding force of the sheet holding system 20 (21, 41) to be removed at the predetermined timing, and enables the sheet separator 140. At this time, the separation claw 141 separates the paper sheet M from the peripheral surface 11 of the rotary drum 10, and upon separation, delivers the paper sheet M to the sheet feed-out mechanism 160 side disposed above the print head 200.

The sheet feed-out mechanism 160 feeds the paper sheet M at a speed corresponding to the peripheral speed of the rotary drum 10 until the trailing end of the paper sheet M is separated from the peripheral surface 11 of the rotary drum 10. After the trailing end is separated from the peripheral surface 11, the speed is switched to a low speed capable of prolonging the natural dry time. The print surface of the paper sheet M fed for discharging is forcibly dried by the ink dryer 181 disposed at the terminal of the sheet feed-out mechanism 160. Thereafter, the paper sheet M can be quickly discharged to the discharge tray 192 or the upper discharge tray 193 upon switching by the discharge switch 190. Even if the discharged paper sheet M is manually touched, no ink blur or the like occurs.

Upon completion of the printing operation, the head loader section 220 moves the print head 200 backward, and the tube opening/closing unit 218 is operated to close the ink return tube. Each ink-jet nozzle 207 is cleaned since ink is forcibly jetted from each ink-jet nozzle 207 upon increase of the pressure in the ink buffer 206. Upon this operation, the waste ink is collected by the waste ink collecting unit 230. Then, each ink-jet nozzle 207 is covered with the cap 246 moved up by the cap elevator 240 to prevent the ink from drying.

According to the above-described embodiment, the rotary drum 10 rotatable about the shaft 10S at a constant peripheral speed, the sheet holding system 20 capable of holding the paper sheet M on the peripheral surface 11 of the rotary drum 10, and the print head 200 positionally shifted in the rotational direction of the rotary drum 10 are arranged to enable color printing by spitting color inks from the ink-jet nozzles 207 of the print head 200 on the paper sheet M rotating together with the rotary drum 10. The loading roller unit 90 capable of loading the paper sheet M to the rotary drum 10, the position sensor 101 for detecting the rotational position of the rotary drum 10, and the control unit 250 for performing a control of feed the paper sheet to the drum side via the loading roller unit 90 when the detected position coincides with the preset position are arranged to enable printing on the paper sheet M which is held and rotated by the rotary drum 10 after loading. Therefore, the multi-color printing speed can be greatly increased, and the continuous printing operation for many (500) paper sheets can be attained. At the same time, since the same holding position on the rotary drum 10 can be maintained, the holding operation can be more reliably performed, and the printing quality can be further improved.

The sheet holding system 20 is formed of the charger 51 and the like to hold the paper sheet M on the rotary drum 10 using an electrostatic attraction force. The discharger 55 and the mechanical sheet separator 140 are arranged to separate the paper sheet M from the rotary drum 10. The paper sheet M can be more stably, reliably held by the rotary drum 10, and the paper sheet M can be smoothly separated from the rotary drum 10. Therefore, high-speed continuous color printing can be stably performed.

The negative-pressure suction holding section 21 is arranged as assistance for the sheet holding system 20 (51). The paper sheet M is held on the peripheral surface 11 of the drum by negative-pressure suction applied via the suction holes 12 which extend through the drum in the radial direction to communicate with the internal and external spaces. Accordingly, the paper sheet M can be more reliably, stably held.

The clamp claw holding section 41 is arranged to clamp the peripheral part of the paper sheet M held by the negative-pressure suction holding section 21, and to press the paper sheet M against the peripheral surface 11. The paper sheet M can be more reliably, stably held.

Since the sheet holding system 20 (41) uses rotation of the rotary drum 10 to perform clamping by the clamp claw 42 and clamping release, a small number of mechanisms (43, 44) can be mounted on the rotary drum 10 to reduce the rotation load.

The sheet feed-in mechanism 60 is formed of the manual feeder 61, the cassette feeder 71, and the feeder switching section 81. The fed paper sheet M is fed to the rotary drum 10 side via the loading roller unit 90 which has a function of correcting the posture thereof. Since the ink-jet printer can widely cope with change (selection) in paper sheets used for printing, it can be easily handled. With an increase in printing speed, e.g., 500 paper sheets can be quickly color-printed without interruption.

Since printing is simultaneously performed in the row direction X by synchronous movement of the respective nozzle unit segments 205 and in the column direction Y by high-speed rotation of the paper sheet M, the printing speed can be further increased.

Color printing can be performed at a predetermined resolution by using the ink-jet nozzle pitch PT set N times the reference pitch PTp necessary for obtaining the predetermined resolution since the rotary drum 10 rotates N revolutions and the print head 200 moves in the main scanning direction X by the reference pitch PTp every revolution of the rotary drum 10. Accordingly, the print head 200 can be greatly reduced in cost. Further, each nozzle unit can be constituted by ink-jet nozzles aligned in the direction X or groups of ink-jet nozzles directly or indirectly aligned in the direction X can be used to form the print head 200.

Since the reciprocating amount of the print head 200 in the direction X is set at 1/600 (=4 dots) the whole width (e.g., 240 dots), the primary factor of hindering an increase in printing speed in the direction X can be reliably eliminated.

Since the color ink-jet nozzles 207 are set on the normal line of the rotary drum 10, the shapes and sizes of spitted color ink dots on the paper sheet M can be uniformed. Therefore, higher-quality printing can be performed.

Color printing can be performed at a resolution set N times the resolution corresponding to the ink-jet nozzle pitch PT in a case where the rotary drum 10 rotates N revolutions and the print head 200 moves by the head shifter section 110 by 1/N the ink-jet nozzle pitch PT during one revolution of the rotary drum 10. Accordingly, by changing the revolution number (N) of the rotary drum 10 and the moving amount (PT×1/N) of the print head 200 per revolution of the rotary drum 10, a desired resolution can be obtained in color printing while keeping the ink-jet nozzle pitch PT constant.

Since the related ink-jet nozzles 207 of the nozzle units in the print head 200 are disposed at the same position in the axial direction X of the drum, higher-quality printing can be attained from this viewpoint.

Since the print head 200 has nozzle units arranged in the drum rotational direction and each formed of (four) nozzle segments 205A to 205D arranged in the drum axial direction X, the print head 200 can be technically easily prepared at low cost. Further, each of the nozzle unit segments 205A to 205D is deviated from adjacent ones 205 in the drum rotational direction to form a zigzag shape. Therefore, the arrangement space and weight can be minimized to increase the color printing speed in the direction X.

Since the driving source of the head shifter section 110 is formed of one motor unit 121 having the retraction-switchable reciprocating rod 122, reciprocation of the print head 200 in the direction X can be quietly, smoothly, quickly performed. Therefore, higher-quality, higher-speed printing can be realized. In addition, since the moving speed of the print head 200 is switched to be higher in the backward movement (X2), the printing speed can be further improved.

The loading roller unit 90 is formed so as to operate after the leading end Mf of the paper sheet M is struck against the contact 99 between the pair of rollers 91 and 92 to correct its posture. Since the paper sheet M is loaded to the rotary drum 10 without any slant, it can be accurately held on the rotary drum 10.

Further, the loading roller unit is formed so as to operate when it is detected by the position sensor 101 that the rotational position of the rotary drum 10 reaches the preset position. Therefore, the paper sheet M can be held on the rotary drum 10 at a proper timing.

Since the ink dryer 130 is arranged to positively dry the ink on the paper sheet M held on the rotary drum 10, the printing speed and the printing quality can be further increased.

The ink dryer 181 forcibly dries the printing surface of the paper sheet M being separated from the rotary drum 10 and fed for discharging. Therefore, no ink blur or mixing occurs even if the paper sheet M is manually touched immediately after discharging. From this viewpoint, the handing can be facilitated in addition to an increase in the printing speed.

The sheet feed-out mechanism 160 is formed such that the paper sheet M separated from the rotary drum 10 by the sheet separator 140 can fed at a speed corresponding to the peripheral speed of the rotary drum 10. Therefore, continuous high-speed color printing can be further enhanced.

Since the sheet feed-out mechanism 160 includes the belt conveyor 161 to be set in contact with the non-printing surface of the paper sheet M and the belt conveyors 171 to be set in contact the printing surface, the printed paper sheet M can be stably, smoothly fed for discharging. The separation claw 141 further enhances this.

The discharge switch 190 is arranged on the lower stream side of the sheet feed-out mechanism 160 and can selectively switch between two directions to discharge the paper sheet M. Accordingly, the printed paper sheet M can be more easily handled.

Since each color ink tank 213 is disposed at a position spaced apart from the print head 200, the capacity of the ink tank 213 can be increased. Therefore, the interval of cumbersome exchange of the ink tank 213 can be prolonged, so that color printing can be continuously performed for a long period of time. A decrease in load of the print head 200 increases the reciprocating speed of the print head 200 in the direction X.

The ink supply section 210 connects the print head 200 and each color ink tank 213 via the ink supply tube 215, and can keep the pressure of each color ink constant with the pressurizing unit 216. Therefore, flexibility in the layout can be greatly increased, and higher-quality printing can be performed.

Each ink-jet nozzle 207 of the print head 200 can be set apart from or close to the rotary drum 10 by the head loader section 220, and is covered with the cap 246 lifted by the cap elevator 240 in a state that it is set apart from the rotary drum 10. Therefore, the ink of the nozzle can be prevented from drying.

The sheet feeding structure of the ink-jet printer will be explained in more detail below.

In this printer, the cassette feeder 71, the manual feeder 61, the state switching section 84, and the feed switching section (81) are arranged. Both of the two feeders 71 and 61 can be simultaneously switched to an active state or an idle state, and a rotating feed force can be applied to a selected one of the feed rollers (75, 65) during the active state.

The loading roller unit 90 (91, 92) is arranged between the feeders 71 and 61 and the rotary drum 10. The loading roller driving control unit (250) is arranged to set the loading roller unit 90 in the standby state waiting for a loading operation to the rotary drum 10. In this state, the loading rollers 91 and 92 bite the leading end side of the fed paper sheet M, and the feeders 71 and 61 are set in the idle state so that the trailing end side of the paper sheet M can be kept in a free state.

The sheet feed-in mechanism 60 is made up of the manual feeder 61 and the cassette feeder 71, and feeds pare sheet (a plain paper sheet, an OHP sheet, or the like) M to the loading roller unit 90 side when the active state is set by the state switching section 84. The loading roller unit 90 loads the paper sheet M to the rotary drum (not shown). When pairs of feed rollers are included in the loading roller unit 90, the loading rollers 91 and 92 are constructed by the feed rollers located on the uppermost stream side.

As shown in FIG. 13, the manual feeder 61 is constituted by the manual feed tray 62 openably mounted on the side part of the printer case 1, the feed roller 65 rotatable at a predetermined position, a pivot lever 65L pivotal and inclinable about the pin 65P, and a friction plate (separation pad) 65F attached via the holder 65H so as to feed a manually fed paper sheet M to the loading rollers 91 and 92. A feed force to the feed roller 65 is applied from the section 81 (motor 82, gear train 83) via the one-way clutch 65C.

The cassette feeder 71 is constituted by the detachable cassette 72 (table 73) in the printer case 1, and the feed roller 75 rotatably mounted on the cassette lever 89, so as to feed the paper sheet M stored in the cassette 72 to the loading rollers 91 and 92. A feed force is also applied to the feed roller 75 from the section 81 via the one-way clutch 75C only when the feed roller 75 is in the active state indicated by the solid line.

The front end (right side in FIG. 13) of the table 73 is pressurized upward by a spring (not shown). The cassette 72 (73) can store (mount) 500 paper sheets M. The separation claw and the like are not illustrated in FIG. 13.

Figure 21:
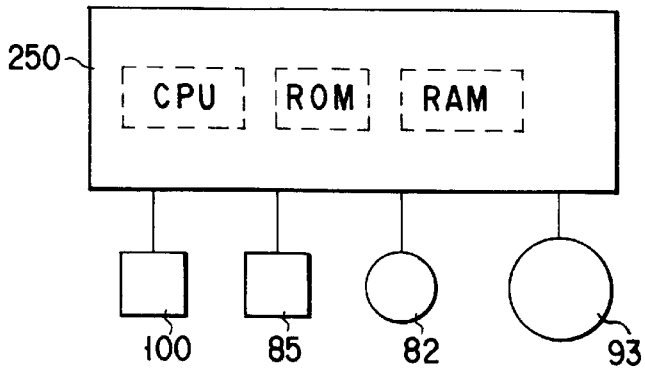
FIG. 21 is a circuit diagram of a control unit shown in FIG. 4.

The feed switching section for selectively switching between the feed rollers 65 and 75 and applying a rotating feed force is formed of a feed control unit constituted by the control unit (including a CPU, a ROM, a RAM, and the like) 250 shown in FIG. 21, the motor 82, the gear train 83, and the two one-way clutches 65C and 75C. That is, the rotating feed force can be applied to only the cassette feed roller 75 via the one-way clutch 75C when the motor 82 rotates in one direction under the control of the feed control unit (250), and to only the manual feed roller 65 via the one-way clutch 65C when the motor 82 rotates in the other direction under the control of the feed control unit (250) (ST12 and ST13 in FIG. 22).

The state switching section 84 is made up of the switching mechanism 86, the actuator 85, and a spring 87SP, so as to simultaneously switch both the feeders 71 and 61 into a selected one of the active state and the idle state.

The switching mechanism 86 is constituted by the switching lever 87 pivotal about the pin 87P, the cassette lever 89 (pivotal about the pin 89P) loosely coupled to the switching lever 87 via a coupling pin 87N in the longitudinal direction of the groove, and the manual feed lever 88 (pivotal about the pin 88P) coupled to the switching lever 87 via the engaging pin 87K.

More specifically, in the active state indicated by the solid line, the switching lever 87 brings the feed roller 75 mounted on the cassette lever 89 into contact with the paper sheet M on the table 73, and the friction plate 65F into contact with the feed roller 65 via the manual feed lever 88 at a predetermined pressure.

In the idle state indicated by the chain double-dashed line, the switching lever 87 separates the feed roller 75 upward from the paper sheet M, and the friction plate 65F downward from the feed roller 65.

The switching lever 87 can normally maintain the idle state using the urging force (tension) of the spring 87SP, and switch to the active state using an external force (switching force) applied from the actuator (e.g., of a solenoid type) 85 via the a driving rod 85R and oriented leftward in FIG. 13 against the urging force of the spring 87SP.

Figure 22:
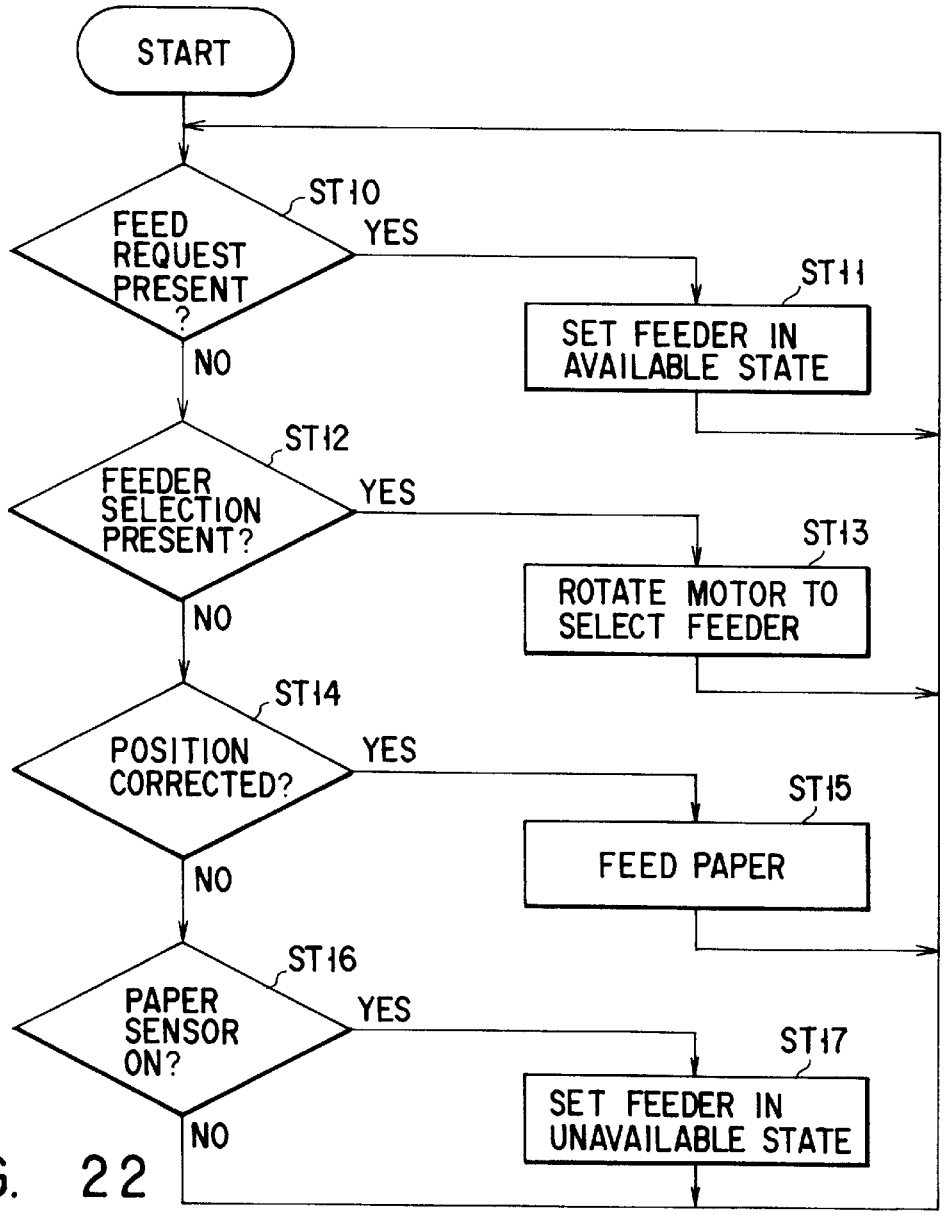
FIG. 22 is a flowchart showing the operation of the control unit shown in FIG. 4.

This state switching operation is executed by the state switching control unit constituted by the control unit (including the CPU, the ROM, the RAM, and the like) 250 shown in FIG. 21 (ST10 and ST11 in FIG. 22). That is, these states are switched by turning on and off the actuator 85. The loading roller unit 90 disposed above the sheet feed-in mechanism 60 in FIG. 13 includes the pair of loading rollers 91 and 92, and has a functions of correcting a posture of the fed paper sheet M and a function of setting a standby state, in addition to a function of loading the fed paper sheet M to the rotary drum 10.

The bend accepting space SP for the paper sheet M is formed in the guide 60G located between the sheet feed-in mechanism 60 and the loading roller unit 90. The feed control unit (250) is formed to perform a control of feeding the paper sheet M by a distance larger than the distance from the feed roller 75 to the contact 99 between the two loading rollers 91 and 92 in cassette paper feed, and a distance larger than the distance from the feed roller 65 to the contact 99 in manual paper feed (ST13 in FIG. 22).

As a result of this control, the leading end of the fed paper sheet M is struck (abutted) against the contact 99 extending in the axial direction of the two loading rollers 91 and 92, and the posture of the paper sheet (more specifically, the leading end) M is corrected to enable feed of the paper sheet M to the rotary drum 10 side without any slant. At this time, posture correction is assisted by an elastic resuming force corresponding to a bend of the paper sheet M in the bend accepting space SP.

Figure 1:
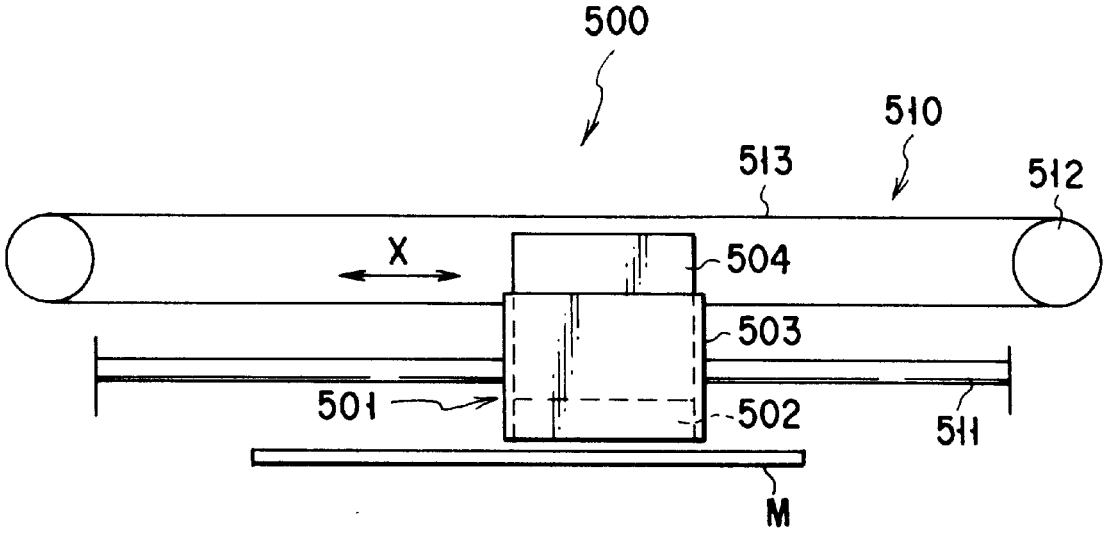
FIG. 1 (PRIOR ART)
FIG. 1 is a plan view schematically showing the internal structure of a conventional ink-jet printer.
Figure 2:
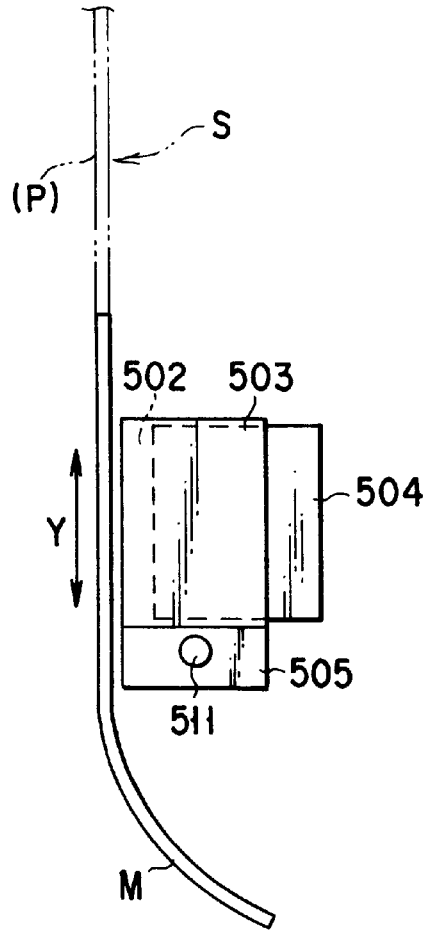
FIG. 2 (PRIOR ART)
FIG. 2 is a side view schematically showing the internal structure of the conventional ink-jet printer, similar to FIG. 1.
Figure 3:
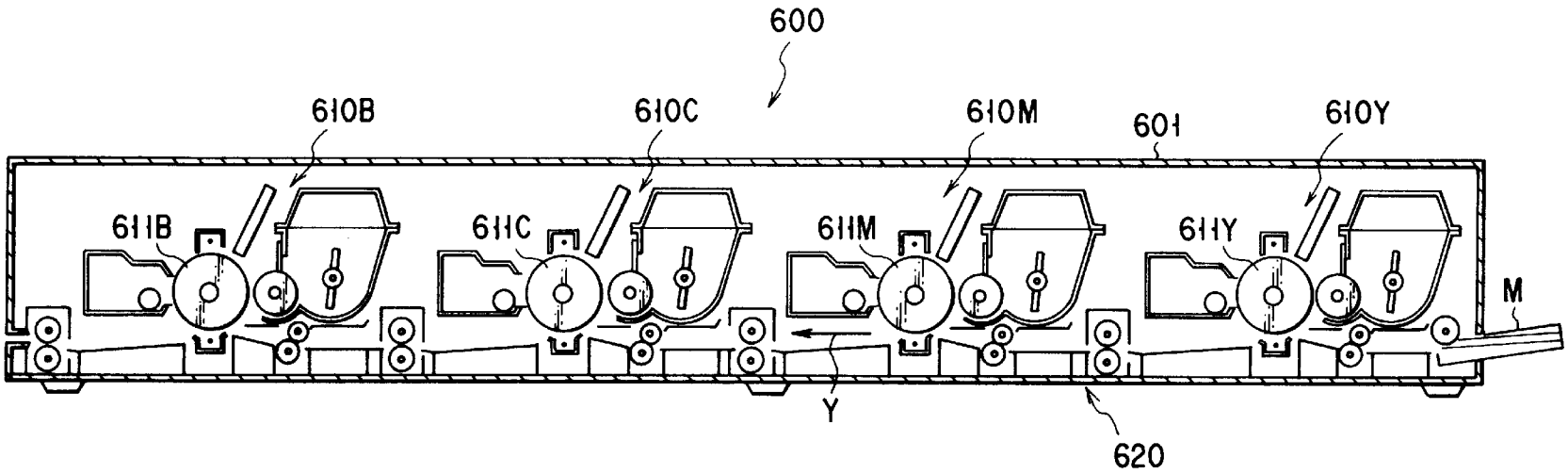
FIG. 3 (PRIOR ART)
FIG. 3 is a sectional view schematically showing the internal structure of a conventional laser printer.

The loading roller driving control unit is formed of the control unit 250. After the posture of the fed paper sheet M has been corrected upon strike of the leading end against the contact 99 between the loading rollers 91 and 92 (YES in ST14 of FIG. 22), the loading roller driving control unit enables rotation of the loading rollers 91 and 92 by the motor 93 shown in FIG. 2 to feed the paper sheet M to the rotary drum 10 side by a length not greater than the sheet amount present in the bend accepting space SP. Completion of the posture correction is inferred from the time elapse after feed completion by the feed control unit (250).

The length not greater than the sheet amount present in the bend accepting space SP is preset such that no tension is applied from the loading rollers 91 and 92 to the contact between the feed roller 65 (75) and the paper sheet M fed by the loading rollers 91 and 92.

In this embodiment, to reliably and easily feed the paper sheet M by a preset length, the loading roller driving control unit is formed to determine that the paper sheet M has been fed by the preset length when the paper sensor 100 (light-emitting element 100E, and light-receiver element 100R) arranged near the rotary drum 10 detects the leading end of the paper sheet M and then stop the loading rollers (YES in ST16 of FIG. 22).

Since the leading end side of the paper sheet M fed as described above is bit by the loading rollers 91 and 92, the paper sheet M can be loaded to the rotary drum 10 for a printing operation anytime. That is, the standby state (wait state) can be established. Loading of the paper sheet M to the rotary drum 10 is also controlled by the loading roller driving control unit (250). In this case, the paper sheet M is fed until the trailing end of the paper sheet M passes the loading rollers 91 and 92.

To make the standby state more effective, after the standby state is established by feeding the paper sheet M by a preset length, the loading roller driving control unit (250) operates in association with the state switching section 84 (85) to simultaneously switch the two feeders 61 (65) and 71 (75) into the idle state (ST17 in FIG. 22). Accordingly, the trailing end side of the paper sheet M can be released into a free state.

The operation of the above-described sheet feeding structure will be explained in more detail below.

When a feed request is generated by the control unit 250 serving as the state switching control unit (250) (YES in ST10 of FIG. 22), it operates the state switching section 84 (ST11). That is, the switching lever 87 of the switching mechanism 86 is pivoted about the pin 87P against the urging force (tension) of the spring 87SP by the actuator 85 shown in FIG. 13 to be in a state indicated by the solid line.

Figure 23A:
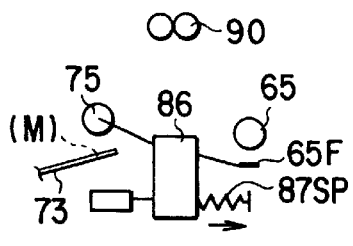
FIGS. 23A to 23E are views, respectively, showing the operation of the sheet feed-in mechanism shown in FIG. 13.
Figure 23B:
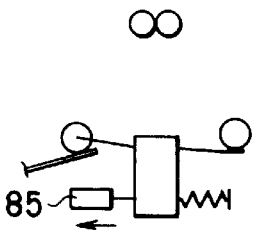

As a result, the feed roller 75 of the cassette feeder 71 is set in contact with the paper sheet M by the movement of the cassette lever 89. At the same time, the friction plate 65F of the manual feeder 61 is set in contact with the lower portion of the feed roller 65 by the movement of the manual feed lever 88, the pivot lever 65L, and the holder 65H. That is, the feeders 71 and 61 can be simultaneously switched from an idle state shown in FIG. 23A to an active state shown in FIG. 23B.

When cassette feed is selected (YES in ST12), the feed control unit (250) controls the motor 82 of the section 81 to rotate in one direction. This rotating feed force is applied to the feed roller 75 via the gear train 83 and one one-way clutch 65C of the force application switching section. Therefore, the paper sheet M in the cassette 72 can be fed to the loading roller unit 90 side (ST13).

Figure 23C:
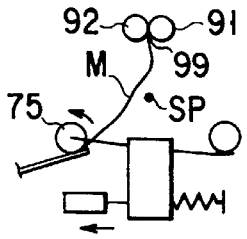

As shown in FIG. 23C, the leading end of the paper sheet M is struck against the contact 99 between the loading rollers 91 and 92 to correct its posture. Since the feed amount at this time is larger than the distance between the feed roller 75 and the contact 99, the middle portion of the paper sheet M bends in the bend accepting space SP of the paper guide 60G. Since the trailing end of the paper sheet M is fixed by the feed roller 71, an elastic resuming force created by the bend serves to more strongly press the leading end against the contact 99. That is, the elastic resuming force assists the posture correction, so that the posture can be more reliably corrected.

Figure 23D:
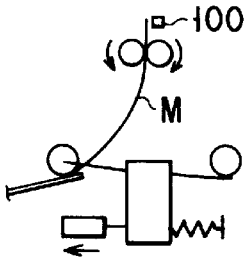

When completion of the posture correction is determined by time management (YES in ST14), the loading roller driving control unit (250) operates the loading roller unit 90 (motor 93). That is, the loading roller driving control unit (250) causes the paper sheet M to be fed by a preset length by rotating the loading rollers 91 and 92, as shown in FIG. 23D. In this embodiment, when the leading end of the paper sheet M is detected by the paper sensor 100 (YES in ST16), feeding is stopped.

Since the leading end side of the paper sheet M is bit by the loading rollers 91 and 92, the standby state can be established so as to feed the paper sheet M to the rotary drum 10 side at any timing convenient for the rotary drum. Accordingly, during the sequence of feeding-in, loading, and feeding-out of a paper sheet M, feeding-in of the next one can be done. This enables high-speed printing.

Figure 23E:
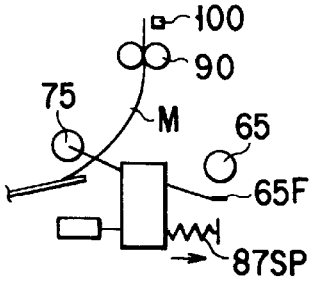

When the paper sensor 100 is turned on (YES in ST16), the state switching control unit (250) turns off the actuator 85 (ST17). The switching lever 87 is switched by the urging force of the spring 87SP from a state shown in FIG. 23D to a state shown in FIG. 23E.

More specifically, as indicated by the chain double-dashed line in FIG. 13, the lever 87 is switched to an idle state wherein the feed roller 75 is separated upward from the next paper sheet M on the table 73, and the friction plate 65F is separated downward from the feed roller 65. Therefore, it is possible to completely prevent double feeding of paper sheets and malfunction feeding of a paper sheet manually inserted due to a mistake.

According to this paper feed structure, the state switching section 84, the loading roller unit 90, the loading roller driving control unit (250), and the state switching control unit (250) are arranged to establish a standby state waiting for the feeding of the paper sheet M to the rotary drum 10 side. In the standby state, the loading rollers 91 and 92 bite the leading end side of the fed paper sheet M, and both of the cassette feeder 71 and the manual feeder 61 are set in the idle state so that the trailing end side of the paper sheet M can be kept in a free state. Therefore, the paper sheet M can be quickly fed and loaded to the rotary drum 10 with an accurate posture.

The cassette feeder 71, the manual feeder 61, the state switching section 84, and the force application switching section (75C, 75C) are arranged to simultaneously set both the two feeders 71 and 61 into a selected one of active and idle states and apply a rotating feed force to a selected one of the feed rollers (75, 65) during the active state. The cassette and manual feeders are simultaneously set into the idle state, double feeding of paper sheets, and a malfunction feeding can be prevented. Further, the next paper sheet can be fed and loaded at a high speed.

The state switching section 84 is formed to switch the cassette feeder 71 and the manual feeder 61 to the idle state by separating the feed roller 75 from the paper sheet M and the friction plate 65F from the feed roller 65, respectively. The cassette feeder 71 does not influence the cassette 72 side, whereas only the friction plate 65F is moved on the manual feeder 61 side. Accordingly, the structure can be simplified.

The state switching section 84 is formed to maintain the idle state using the urging force of the spring 87SP, and switch the idle state to the active state against the urging force of the spring 87SP. Application of an external force against the urging force of the spring 87SP is not required except for the time of feeding the paper sheet M. Power and the like can be saved while securing the safety side from a failure of the force application switching section (65C, 75C, or the like), and a like.

Since the force application switching section is formed of the motor 82, the gear train 83, and the two one-way clutches 65C and 75C, and feed the paper sheet M under the control of the feed control unit (250), the paper sheet M can be reliably fed by a preset length by a selected one of the feed rollers (65, 75).

Since the feed control unit (250) performs a control of feeding the paper sheet M by a distance larger than the distance between the feed rollers 65 and 75 and the contact 99, and the bend accepting space SP is formed between them, the leading end of the paper sheet M can be pressed at a large pressure. Therefore, the posture correcting function of the loading roller unit 90 can be more reliably realized.

Since the loading roller driving control unit (250) is formed so as to stop the feeding of the paper sheet M when the paper sensor 100 detects the leading end of the paper sheet M, feeding control can be facilitated, and more stably performed.

The above-mentioned embodiment has exemplified the case wherein the loading roller unit 90 (91, 92) is arranged to be set into a standby state in which the paper sheet M fed from the feeder 60 (61, 71) is temporarily bit by the loading rollers 91 and 92. However, when only double feeding of paper sheets or a malfunction feeding must be prevented, no loading roller unit 90 (91, 92) is required. That is, the paper sheet M can be directly fed from the feeder 60 to the rotary drum 10.

What is claimed is:

1. An ink-jet printer comprising:

a rotary drum for rotating at a constant speed and holding a printing medium on a peripheral surface thereof;

a print head having ink-jet nozzles aligned in an axial direction of said rotary drum, for performing printing by providing ink from said ink-jet nozzles on the printing medium rotating together with said rotary drum; and a medium feeding mechanism for feeding the printing medium from a cassette and a manual feed tray to said rotary drum;

wherein said medium feeding mechanism includes:

a loading roller unit for loading the printing medium on the rotary drum, a pickup section for picking up a printing medium from one of said cassette and said manual feed tray to strike a leading end of the printing medium against said loading roller unit, said pickup section including a medium feed path which guides the printing medium picked up from one of said cassette and said manual feed tray to said loading roller unit via a merging point and having a bend accepting space located at the merging point for accepting a bend of the printing medium, and a control section for controlling said pickup section such that the printing medium is elastically deformed in the bend accepting space upon strike against said loading roller unit, and for controlling said loading roller unit such that the printing medium is loaded on said rotary drum after the posture of the printing medium is corrected by an elastic force of deformation.

2. An ink-jet printer according to claim 1, wherein said control section includes a position sensor configured to detect a rotational position of said rotary drum, and a timing adjuster configured to enable feeding of said printing medium to said rotary drum when said position sensor detects that said rotary drum reaches a preset position.

3. An ink-jet printer according to claim 1, wherein said pickup section includes a first feed roller for picking up a printing medium from said cassette, and a second feed roller for feeding a printing medium from said manual feed tray, and said control section includes a feed controller configured to control said first feed roller to feed the printing medium from said cassette by an amount slightly longer than a distance between said loading roller unit and said first feed roller and to control said second feed roller to feed the printing medium from said manual feed tray by an amount slightly longer than a distance between said loading roller unit and said second feed roller.

4. An ink-jet printer comprising:

a rotary drum for rotating at a constant speed and holding a printing medium on a peripheral surface thereof;

a print head having ink-let nozzles aligned in an axial direction of said rotary drum, for performing printing by providing ink from said ink-jet nozzles on the printing medium rotating together with said rotary drum; and a medium feeding mechanism for feeding the printing medium from a cassette and a manual feed tray to said rotary drum;

wherein said medium feeding mechanism includes a loading roller unit for loading the printing medium on the rotary drum, a pickup section for picking up a printing medium from one of said cassette and said manual feed tray to strike a leading end of the printing medium against said loading roller unit, and a control section for controlling said loading roller unit to load, on the rotary drum, the printing medium whose posture is corrected upon strike by said pickup section, wherein said pickup section includes a medium feed path which guides the printing medium picked up from one of said cassette and said manual feed tray to said loading roller unit via a merging point and has bend accepting space located at the merging point for accepting a bend of the printing medium, and wherein said control section comprises a stopper configured to stop said loading roller unit when the printing medium whose posture has been corrected is fed by a preset length not more than a length of said printing medium present in the bend accepting space.

5. An ink-jet printer according to claim 4, wherein said loading roller unit includes a pair of loading rollers which rotate while clamping said printing medium therebetween, and said control section includes a release mechanism configured to control said pickup section to stop and release said printing medium when said printing medium is fed by a preset length and clamped by said pair of loading rollers.

6. An ink-jet printer according to claim 5, wherein said pickup section includes a cassette feeder configured to pick up a printing medium from said cassette, a manual feeder configured to pick up a printing medium from said manual tray, and a driver configured to select and drive one of said cassette feeder and said manual feeder.

7. An ink-jet printer according to claim 6, wherein each of said cassette feeder and said manual feeder has a support plate for supporting the printing medium, and a feed roller set in contact with said printing medium on said support plate to feed the printing medium by friction, and said release mechanism includes a friction reducer configured to reduce friction between said feed roller and said printing medium.

8. An ink-jet printer according to claim 7, wherein said cassette feeder has a spring for pressing the feed roller of said cassette feeder against said printing medium, said manual feeder has a spring for pressing said support plate of said manual feeder against said printing medium, and said friction reducer has a mechanism section for separating the feed roller of said cassette feeder from the printing medium against an urging force of the spring of said cassette feeder, and separating the support plate of said manual feeder from the printing medium against an urging force of the spring of said manual feeder.

9. An ink-jet printer comprising:

a rotary drum for rotating at a constant speed and holding a printing medium on a peripheral surface thereof;

a print head having ink-jet nozzles aligned in an axial direction of said rotary drum, for preforming printing by providing ink from said ink-jet nozzles on the printing medium rotating together with said rotary drum; and a medium feeding mechanism configured to feed the printing medium to said rotary drum;

wherein said medium feeding mechanism includes a loading roller unit for loading the printing medium to the rotary drum, a pickup section for picking up a given printing medium and feeding the printing medium against said loading roller unit, and a control section for controlling said loading roller unit to load the printing medium fed by the pickup section to said rotary drum, said pickup section includes a medium feed path which guides the printing medium to said loading roller unit, said loading roller unit includes a pair of loading rollers which rotate while clamping said printing medium therebetween, and said control section includes a releaser configured to control said pickup section to release said printing medium when said printing medium is clamped by said pair of loading rollers.

* * * * *

UNITED STATES PATENT AND TRADEMARK OFFICE

CERTIFICATE OF CORRECTION

PATENT NO. : 6,070,977
DATED : June 6, 2000
INVENTOR(S) : Akira Nuita et al

It is certified that error appears in the above-identified patent and that said Letters Patent is hereby corrected as shown below:

Item [73] Assignee, change "Shizuoka" to --Tokyo--.

Signed and Sealed this

Twelfth Day of June, 2001

Nicholas P. Godici

*Attest:*

*Attesting Officer*

NICHOLAS P. GODICI
*Acting Director of the United States Patent and Trademark Office*